US010522958B2

(12) United States Patent
Leigh et al.

(10) Patent No.: US 10,522,958 B2
(45) Date of Patent: Dec. 31, 2019

(54) RECEPTACLE FOR CONNECTING A MULTI-LANE OR ONE-LANE CABLE

(71) Applicant: HEWLETT PACKARD ENTERPRISE DEVELOPMENT LP, Houston, TX (US)

(72) Inventors: Kevin B Leigh, Montgomery, TX (US); John Norton, Houston, TX (US); George D Megason, Sr., Spring, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/500,526

(22) PCT Filed: Sep. 26, 2014

(86) PCT No.: PCT/US2014/057858
§ 371 (c)(1),
(2) Date: Jan. 30, 2017

(87) PCT Pub. No.: WO2016/048374
PCT Pub. Date: Mar. 31, 2016

(65) Prior Publication Data

US 2017/0222379 A1 Aug. 3, 2017

(51) Int. Cl.
*H01R 27/00* (2006.01)
*H01R 29/00* (2006.01)

(52) U.S. Cl.
CPC ..... *H01R 27/00* (2013.01); *H01R 29/00* (2013.01)

(58) Field of Classification Search
CPC .... H01R 12/62; H01R 13/514; H01R 13/627; H01R 12/716; H01R 12/75; H01R 13/518; H01R 2107/00; H01R 24/60; H01R 27/02; G02B 6/26; G02B 6/36; G02B 6/3825;
(Continued)

(56) References Cited

U.S. PATENT DOCUMENTS 3,521,332 A 7/1970 Kramer
4,386,752 A 6/1983 Pavlak
4,767,338 A 8/1988 Dennis
(Continued)

FOREIGN PATENT DOCUMENTS

CN 101789575 7/2010
CN 102210065 A 10/2011
(Continued)

OTHER PUBLICATIONS

"8 Channel Dula Multi-lane Sata2 Enclosure Device Bracket Scsi Opening," Retrieved from Internet Sep. 15, 2014, http://www.satacable.com/8-channel-dula-multi-lane-sata2-enclosure-device-bracket-scsi-opening.html.
(Continued)

*Primary Examiner* — James Harvey
*Assistant Examiner* — Matthew T Dzierzynski
(74) *Attorney, Agent, or Firm* — Dicke, Billig & Czaja, PLLC

(57) ABSTRACT

One example of a system includes a receptacle including a plurality of bays. Each bay of the receptacle supports 1-lane of network communications. The receptacle is to connect to a multi-lane cable to provide a multi-lane port or connect to a plurality of 1-lane cables to provide a plurality of 1-lane ports.

13 Claims, 17 Drawing Sheets

(58) Field of Classification Search
CPC .... G02B 6/387; G02B 6/3895; G02B 6/3879; H05K 5/0065
See application file for complete search history.

(56) References Cited

U.S. PATENT DOCUMENTS

| | | | | |
|---|---|---|---|---|
| 5,263,671 | A | 11/1993 | Baum | |
| 5,386,487 | A | 1/1995 | Briggs | |
| 5,559,590 | A | 9/1996 | Arai et al. | |
| 5,564,939 | A | 10/1996 | Maitani et al. | |
| 5,586,906 | A | 12/1996 | Staros et al. | |
| 5,669,590 | A | 9/1997 | Przewodek | |
| 5,993,237 | A | 11/1999 | Kern, Jr. et al. | |
| 6,062,516 | A | 5/2000 | Rizzo | |
| 6,175,080 | B1 | 1/2001 | Nightingale | |
| 6,216,410 | B1 | 4/2001 | Haberman | |
| 6,219,479 | B1 | 4/2001 | Madden | |
| 6,364,721 | B2 | 4/2002 | Stewart, III | |
| 6,378,811 | B1 | 4/2002 | Potter | |
| 6,669,150 | B2 | 12/2003 | Benoit | |
| 6,808,116 | B1 | 10/2004 | Eslambolchi | |
| 6,887,091 | B1 | 5/2005 | Wu | |
| 6,926,237 | B2 | 8/2005 | Shereyk | |
| 7,044,802 | B2 * | 5/2006 | Chiou | G06K 19/07732 439/638 |
| 7,055,784 | B2 | 6/2006 | Stigler | |
| 7,119,280 | B1 | 10/2006 | Ray | |
| 7,134,908 | B2 | 11/2006 | Wu | |
| 7,241,163 | B1 | 7/2007 | Ray et al. | |
| 7,294,789 | B1 | 11/2007 | Watthanasintham | |
| 7,318,740 | B1 | 1/2008 | Henry et al. | |
| 7,494,353 | B2 | 2/2009 | Choi | |
| 7,494,363 | B1 | 2/2009 | Wu | |
| 7,605,707 | B2 | 10/2009 | German | |
| 7,622,682 | B2 | 11/2009 | Malin | |
| 7,648,392 | B2 | 1/2010 | Chambers et al. | |
| 7,654,831 | B1 | 2/2010 | Wu | |
| 7,661,979 | B2 | 2/2010 | Hughes | |
| 7,789,718 | B2 | 9/2010 | Desard | |
| 7,841,889 | B2 | 11/2010 | Gerard et al. | |
| 7,845,859 | B2 | 12/2010 | Roth et al. | |
| 8,212,145 | B2 | 7/2012 | Nagai | |
| 8,340,123 | B2 * | 12/2012 | Barbieri | G06F 13/409 370/466 |
| 8,370,704 | B2 | 2/2013 | Ganga et al. | |
| 8,475,197 | B2 | 7/2013 | Zerebilov et al. | |
| 8,506,176 | B2 | 8/2013 | Daikuhara et al. | |
| 8,585,426 | B2 | 11/2013 | Zerebilov | |
| 8,596,882 | B2 * | 12/2013 | Smrha | G02B 6/3825 385/76 |
| 8,636,544 | B1 | 1/2014 | Briant | |
| 8,639,082 | B2 | 1/2014 | Haley | |
| 8,645,747 | B2 | 2/2014 | Buckland et al. | |
| 8,668,525 | B1 | 3/2014 | Tu et al. | |
| 8,770,990 | B2 | 7/2014 | Sytsma et al. | |
| 8,867,883 | B2 | 10/2014 | Crain | |
| 8,882,514 | B2 | 11/2014 | Enge | |
| 8,910,912 | B2 | 12/2014 | Child | |
| 8,926,339 | B2 | 1/2015 | Houtz | |
| 9,088,119 | B2 * | 7/2015 | Baker | H01R 31/005 |
| 2004/0048506 | A1 | 3/2004 | Chung et al. | |
| 2004/0115997 | A1 | 6/2004 | Scherer | |
| 2005/0098688 | A1 | 5/2005 | Miarka | |
| 2005/0224585 | A1 | 10/2005 | Durrant | |
| 2005/0271328 | A1 | 12/2005 | Ohtsu | |
| 2006/0148279 | A1 | 7/2006 | German | |
| 2006/0189180 | A1 | 8/2006 | Lang | |
| 2007/0111598 | A1 | 5/2007 | Quilici | |
| 2007/0232132 | A1 | 10/2007 | Ling | |
| 2010/0062627 | A1 | 3/2010 | Ambo | |
| 2010/0065327 | A1 | 3/2010 | Lin | |
| 2010/0130063 | A1 | 5/2010 | Lang et al. | |
| 2011/0034082 | A1 | 2/2011 | Zhu | |
| 2011/0165785 | A1 | 7/2011 | Lindner | |
| 2011/0168423 | A1 | 7/2011 | Hagi | |
| 2011/0237112 | A1 | 9/2011 | Wu | |
| 2011/0300735 | A1 | 12/2011 | Wu | |
| 2012/0129382 | A1 | 5/2012 | Regnier | |
| 2012/0251064 | A1 | 10/2012 | Crain | |
| 2013/0005173 | A1 | 1/2013 | Reed et al. | |
| 2013/0183846 | A1 | 7/2013 | Kappla et al. | |
| 2013/0231011 | A1 | 9/2013 | Sytsma | |
| 2014/0038447 | A1 | 2/2014 | Brown | |
| 2014/0041937 | A1 | 2/2014 | Lloyd et al. | |
| 2014/0205243 | A1 | 7/2014 | Baker | |
| 2014/0363171 | A1 | 12/2014 | Tang et al. | |
| 2015/0244109 | A1 | 8/2015 | Byczkiewicz et al. | |

FOREIGN PATENT DOCUMENTS

| | | |
|---|---|---|
| JP | 2007317434 | 12/2007 |
| JP | 2009076375 | 4/2009 |
| KR | 1020100068002 | 6/2010 |
| TW | I267238 | 11/2006 |
| TW | M430018 | 5/2012 |
| WO | WO-2014043426 | 3/2014 |

OTHER PUBLICATIONS

Dennis Martin, "Demartek Storage Networking Interface Comparison," May 9, 2014, http://www.demartek.com/Demartek_Interface_Comparison.html.

Neer, et al.; "Advanced SAS Connections Converge at 3.0," Retrieved form Internet Sep. 15, 2014; 5 pages; http://www.serialstoragewire.net/Articles/2009_12/molex.html.

"LC Right Angle Clip" Feb. 22, 2013, <http://www.senko.com/fiber/pdf_brochure/FeaturesBrochure_2013-v5.pdf >.

Accessories for Retaining Helawrap Open Cable Cover HWCLIP08, 3 pages; Retrieved from Internet Sep. 1, 2015, <http://www.hellermanntyton.co.uk/site/products/protective-tubing-and-spiral-binding/hwclip08/161-64002 >.

PCT/ISA/KR, International Search Report and Written Opinion, dated Nov. 11, 2015, PCT/US2015/016283, 9 pps.

PCT/ISA/KR, International Search Report and Written Opinion, dated Jun. 19, 2015, PCT/US2014/057858, 12 pps.

PCT/ISA/KR, International Search Report and Written Opinion, dated Nov. 20, 2015, PCT/US2015/017964, 10 pps.

PCT/ISA/KR, International Search Report and Written Opinion, dated Jan. 22, 2016, PCT/US2015/028277, 14 pages.

"QSFP+ in the 40 Gigabit Ethernet Fiber Optic Media Systems" Retrieved from Internet Feb. 20, 2015, http://www.fiber-optic-equipment.com/tag/qsfp-cables >, 6 pps.

* cited by examiner

198

| | QX1 RECEPTACLE | QX2 RECEPTACLE | QX4 RECEPTACLE |
|---|---|---|---|
| QX1 CABLE | YES | YES | YES |
| QX2 CABLE | NO | YES | YES |
| QX4 CABLE | NO | NO | YES |

340

| | QX1 RECEPTACLE | QX2J RECEPTACLE | QX2S RECEPTACLE | QX4J RECEPTACLE | QX4S RECEPTACLE |
|---|---|---|---|---|---|
| QX1 CABLE | YES | YES | YES | YES | YES |
| QX2J CABLE | NO | YES | NO | YES | NO |
| QX2S CABLE | NO | YES | YES | YES | YES |
| QX4J CABLE | NO | NO | NO | YES | NO |
| QX4S CABLE | NO | NO | NO | YES | YES |

500

| QX2J RECEPTACLE | (P) | (L) |
|---|---|---|
| QX1 CABLES | N/C | N/C |
| QX2S CABLE | N/C | N/C |
| QX2J CABLE | GROUND | GROUND |

Fig. 15

502

| QX4J RECEPTACLE | TOP (P) | TOP (L) | BOTTOM (P) | BOTTOM (L) |
|---|---|---|---|---|
| QX1 CABLES | N/C | N/C | N/C | N/C |
| QX2S CABLES | N/C | N/C | N/C | N/C |
| QX2J CABLES | GROUND | GROUND | GROUND | GROUND |
| QX4S CABLE | N/C | N/C | N/C | N/C |
| QX4J CABLE | GROUND | GROUND | GROUND | N/C |

Fig. 16

RECEPTACLE FOR CONNECTING A MULTI-LANE OR ONE-LANE CABLE

BACKGROUND

High-radix network switch modules may support a high number of connectors on their faceplates. Network port standards allow 1-lane and wider ports (e.g., 12-lane for CXP), and wider ports use larger connectors and thus fewer connectors on the faceplate. Different applications use different port bandwidth. Traditionally, either 1-lane (e.g., Small Form-Factor Pluggable (SFP)) or 4-lane (e.g., Quad Small Form-Factor Piuggable (QSFP)) ports predominate the Ethernet industry. As the bandwidth per lane has reached 10 Gbps, however, not every system can take advantage of QSFP 4-lane ports.

BRIEF DESCRIPTION OF HE DRAWINGS

FIG. 15 is a table illustrating example signal combinations to detect cable types installed in a joint-type QX2 receptacle.

FIG. 16 is a table illustrating example signal combinations to detect cable types installed a joint-type QX4 receptacle.

DETAILED DESCRIPTION

Figures 1A, 1B, 1C:
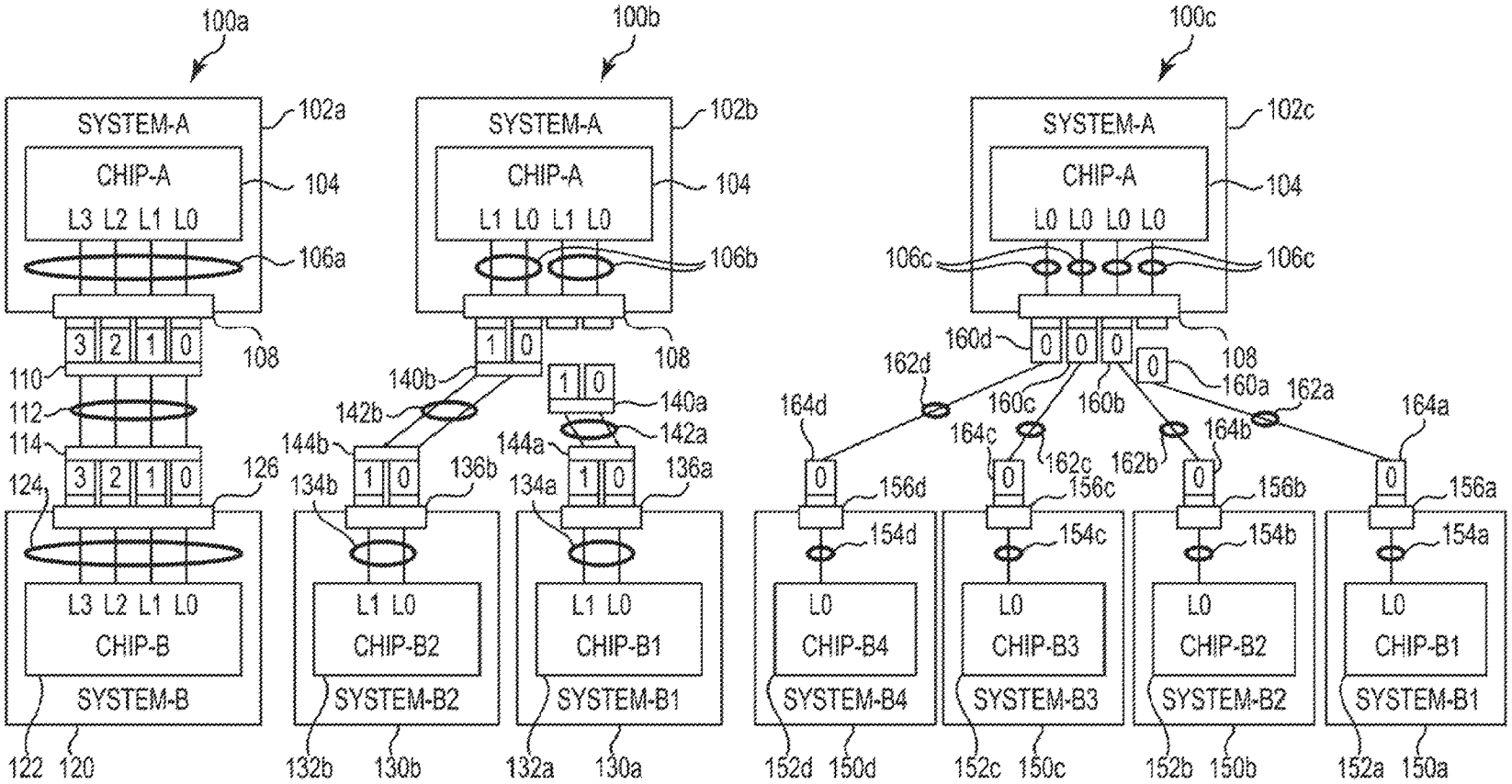
FIGS. 1A-1C illustrate examples of systems including modularly scalable connectors and cables.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Traditional network ports have a fixed number of lanes. A lane includes a pair of transmit differential signals and a pair of receive differential signals for network communications. For example, 1 GbE and 10 GbE can be 1-lane, 10 GbE, 40 GbE, and 100 GbE may be 4-lane, and 100 GbE may be 10-lane, Accordingly, network chips, connectors, and cables have been defined to provide a fixed number of lanes for a network port. Ethernet standards have been emerging where a port of a network chip may be configured to be a 4-lane port (e.g., 4×25 G for 100 GbE), a 2-lane port (e.g., 2×25 G for 50 GbE), or a 1-lane port (e.g., 1×25 G for 25 GbE). Existing connectors and cables for network ports are defined for a fixed number of lanes. This is not a problem for 1-lane ports or for multi-lane ports as long as the application calls for fixed lane-count ports (e.g., QSFP for a 4-lane port). When a multi-lane port of a chip in a network switch system, however, needs to be connected by network interface chips in computer systems having a varying number of lanes (e.g., 1-lane, 2-lane, 4-lane), the fixed lane-count connectors and cables will force certain lanes on a network chip port to be unusable, thus resulting in wasted or stranded lanes. A network chip may be a switch ASIC, a NIC (network interface controller) chip, an electrical transceiver chip (e.g., retimer, redriver), an optical transceiver chip, or a combination of these chips interconnected.

To minimize product models, many switches include QSFP ports. Using only one lane or two lanes out of the available four lanes, however, is wasteful. Therefore, users may buy switches with QSFP 4-lane ports for future proofing, and use break-out cables to fan-out four SFP 1-lane ports or two 2-lane ports for every QSFP port or for every two QSFP ports, respectively. This approach is expensive and can introduce signal integrity and connection reliability issues. Accordingly, this disclosure describes receptacles and cable connectors to allow receptacles on the system side to accept different lane-count cables so that switch manufacturers can design one system with one set of connectors on each faceplate that will allow varying lane-count cables. Switch port signals may be connected to specific receptacle connector bays in a way that all the lanes of the network chips can be used regardless of the cable type installed. Therefore, the disclosure provides for high connector density and lower solution costs by enabling simple and compact connector designs. In addition, management signals may be provided in the connectors for dynamic detection of the cable types so that system management logic can appropriately configure the network switch chips and/or transceiver chips to support the cables installed.

Each network port connection is provided on a switch in the form of a receptacle for an external cable to be connected. Although the receptacles may be implemented on the front or the rear side of a switch, this disclosure uses the term "faceplate" to generically describe where the receptacles are located for cables to be installed.

FIGS. 1A-1C illustrate examples of systems including modularly scalable connectors and cables. FIG. 1A illustrates one example of a system 100*a*. System 100*a* includes a system-A 102*a* and a system-B 120. System-A 102*a* includes a network chip-A 104 communicatively coupled to a receptacle 108 via a 4-lane port 106*a*. System-B 120 includes a network chip-B 122 communicatively coupled to a receptacle 126 via a 4-lane port 124. A cable 112 having a first 4-lane cable connector 110 at one end of the cable and a second 4-lane cable connector 114 at the other end of the cable communicatively couples system-A 102*a* to system-B 120. First 4-lane cable connector 110 is connected to receptacle 108, and second 4-lane cable connector 114 is connected to receptacle 126. In this example, both system-A 102*a* and system-B 120 use a 4-lane receptacle and network chip-A 104 and network chip-B 122 are configured for 4-lanes L0, L1, L2, and L3.

FIG. 1B illustrates one example of a system 100*b*. System 100*b* includes a system-A 102*b*, a system-B1 130*a*, and a system-B2 130*b*. System-A 102*b* includes a network chip-A 104 communicatively coupled to a receptacle 108 via two 2-lane ports 106*b*. System-B1 130*a* includes a network chip-B1 132*a* communicatively coupled to a receptacle 136*a* via a 2-lane port 134*a*. A cable 142*a* having a first 2-lane cable connector 140*a* at one end of the cable and a second 2-lane cable connector 144*a* at the other end of the cable may communicatively couple (shown disconnected in FIG. 1B) system-A 102*b* to system-B1 130*a*. First 2-lane cable connector 140*a* may be connected to receptacle 108, and second 2-lane cable connector 144*a* is connected to receptacle 136*a*.

System-B2 130*b* includes a network chip-B2 132*b* communicatively coupled to a receptacle 136*b* via a 2-lane port 134*b*. A cable 142*b* having a first 2-lane cable connector 140*b* at one end of the cable and a second 2-lane cable connector 144*b* at the other end of the cable communicatively couples system-A 102*b* to system-B2 130*b*. First 2-lane cable connector 140*b* is connected to receptacle 108, and second 2-lane cable connector 144*b* is connected to receptacle 136*b*. In this example, while system-A 102*b* uses a 4-lane receptacle, system-B1 130*a* and system-B2 130*b* use 2-lane receptacles. Network chip-A 104 is configured for a pair of 2-lanes L0, L1, and network chip-B1 132*a* and network chip-B2 132*b* are each configured for a corresponding 2-lanes L0, L1.

FIG. 1C illustrates one example of a system 100*c*. System 100*c* includes a system-A 102*c*, a system-B1 150*a*, a system-B2 150*b*, a system-B3 150*c*, and a system-B4 150*d*. System-A 102*c* includes a network chip-A 104 communicatively coupled to a receptacle 108 via four 1-lane ports 106*c*. System-B1 150*a* includes a network chip-B1 152*a* communicatively coupled to a receptacle 156*a* via a 1-lane port 154*a*. A cable 162*a* having a first 1-lane cable connector 160*a* at one end of the cable and a second 1-lane cable connector 164*a* at the other end of the cable may communicatively couple (shown disconnected in FIG. 1C) system-A 102*c* to system-B1 150*a*. First 1-lane cable connector 160*a* may be connected to receptacle 108, and second 1-lane cable connector 164*a* may be connected to receptacle 156*a*.

System-B2 150*b* includes a network chip-B2 152*b* communicatively coupled to a receptacle 156*b* via a 1-lane port 154*b*. A cable 162*b* having a first 1-lane cable connector 160*b* at one end of the cable and a second 1-lane cable connector 164*b* at the other end of the cable communicatively couples system-A 102*c* to system-B2 150*b*. First 1-lane cable connector 160*b* is connected to receptacle 108, and second 1-lane cable connector 164*b* is connected to receptacle 156*b*.

System-B3 150*c* includes a network chip-B3 152*c* communicatively coupled to a receptacle 156*c* via a 1-lane port 154*c*. A cable 162*c* having a first 1-lane cable connector 160*c* at one end of the cable and a second 1-lane cable connector 164*c* at the other end of the cable communicatively couples system-A 102*c* to system-B3 150*c*. First 1-lane cable connector 160*c* is connected to receptacle 108, and second 1-lane cable connector 164*c* is connected to receptacle 156*c*.

System-B4 150*d* includes a network chip-B4 152*d* communicatively coupled to a receptacle 156*d* via a 1-lane port 154*d*. A cable 162*d* having a first 1-lane cable connector 160*d* at one end of the cable and a second 1-lane cable connector 164*d* at the other end of the cable communicatively couples system-A 102*c* to system-B4 150*d*. First 1-lane cable connector 160*d* is connected to receptacle 108, and second 1-lane cable connector 164*d* is connected to receptacle 156*d*. In this example, while system-A 102*c* uses a 4-lane receptacle, system-B1 150*a*, system-B2 150*b*, system-B3 150*c*, and system-B4 150*d* each use a 1-lane receptacle. Network chip-A 104 is configured for four 1-lanes L0 and network chip-1 152*a*, network chip-B2 152*b*, network chip-B3 152*c*, and network chip-B4 152*d* are each configured for a corresponding 1-lane L0.

In systems 100*a*-100*c*, the network chip-A ports and cable signal paths are fully utilized so there are no stranded lanes. Each cable is independently connecting the corresponding ports on system-A and system-B so there is no single point-of-failure. Each cable is directly coupled between a system-A port and a system-B port such that no additional connectors or cable stages are used, thereby improving signal integrity, improving connection reliability, and reducing cost. In addition, the 4-lane system receptacle may be more compact than four independent 1-lane receptacles. System-A, which is the same in systems 100*a*-100*c*, has receptacle 108 to enable coupling to system-B1, system-B2, system-B3, and system-B4, which have network chips having different lane-counts, by using appropriate lane-count cables, thereby reducing the system-A development cost. Without receptacle 108 and configurable network chip-A 104, different system-A designs would be needed to support varying number of lane count receptacles to avoid stranded ports.

Figures 2, 3:
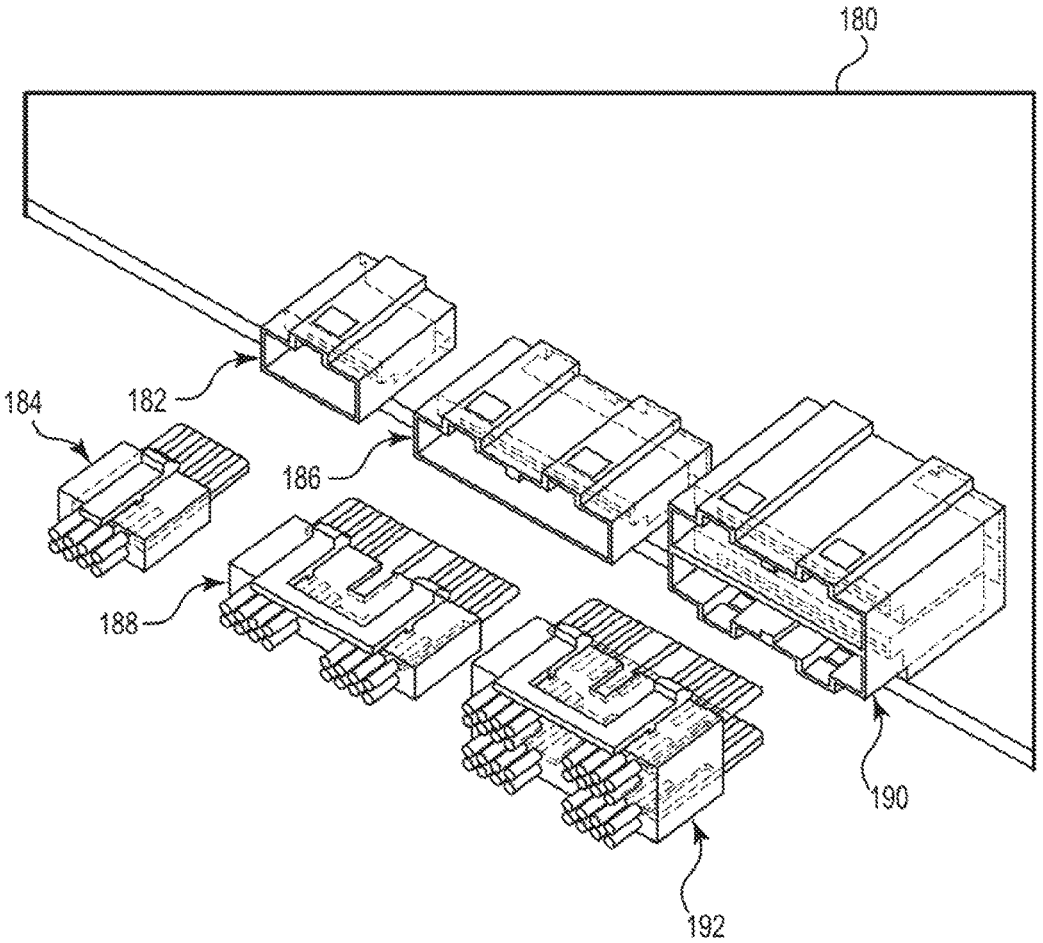
FIG. 2 illustrates examples of faceplate receptacles and corresponding cable connectors.
FIG. 3 is a table illustrating the interoperability among QX receptacles and cables.

FIG. 2 illustrates examples of faceplate receptacles and corresponding cable connectors. As used herein, three receptacle types and three cable types for 1-lane, 2-lane, and 4-lane signals are defined as follows:

QX1—1-lane receptacle and 1-lane cable
QX2—2-lane receptacle and 2-lane cable
QX4—4-lane receptacle and 4-lane cable "QX" can be interpreted as "a quarter times (or multiply by)" where "quarter" may be further interpreted in one example as 25 Gbps of 100 Gbps (e.g., Ethernet standard), or one quarter of a 4-bay receptacle.

FIG. 2 illustrates a QX1 receptacle 182, a QX2 receptacle 186, and a QX4 receptacle 190 mounted on a printed circuit board (PCB) 180, QX1 receptacle 182 is a 1-lane receptacle for connecting to a corresponding QX1 1-lane cable 184. As used herein, the term "cable" includes the cable connector. QX2 receptacle 186 is a 2-lane receptacle for connecting to a corresponding QX2 2-lane cable 188. QX4 receptacle 190 is a 4-lane receptacle for connecting to a corresponding QX4 4-lane cable 192. The signal conductors of QX2 and QX4 cables may be combined in one cable cord (not shown).

FIG. 3 is a table 198 illustrating the interoperability among QX receptacles and cables. As illustrated in table 198, the QX2 receptacle 186 (FIG. 2) may also be connected to two QX1 cables 184, and the QX4 receptacle 190 may also be connected to two QX2 cables 188 or four QX1 cables 184. QX1 receptacle 182 and QX1 cable 184, QX2 receptacle 186 and QX2 cable 188, and QX4 receptacle 190 and QX4 cable 192 are further described below with reference to the following figures.

Figure 4A:
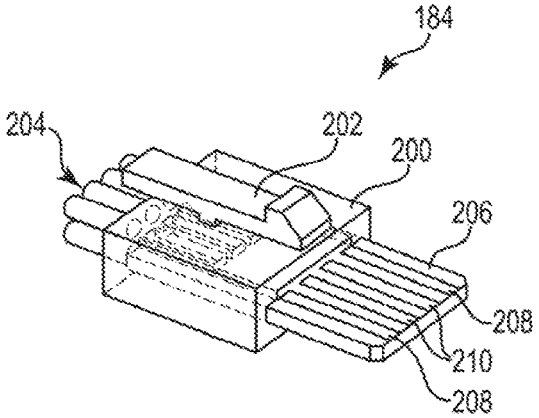
FIGS. 4A-4D illustrate an example QX1 cable and an example QX1 receptacle.

FIGS. 4A-4D illustrate an example QX1 cable 184 and an example QX1 receptacle 182. As illustrated in FIG. 4A, QX1 cable 184 includes a cable connector 200, a latch 202, cable conductors 204, and a cable connector finger 206. Cable conductors 204 are combined within a cable cord (not shown) of the QX1 cable. Latch 202 is attached to cable connector 200. Latch 202 ensures positive retention of QX1 cable 184 in QX1 receptacle 182 when the cable is installed, and allows easy removal of the cable from QX1 receptacle 182. Cable connector finger 206 is supported by cable connector 200 and includes a signal lane (i.e., 1-lane).

A signal lane includes a "transmit" differential-pair of signal pins surrounded by a pair of ground pins, and a "receive" differential-pair of signal pins surrounded by another pair of ground pins. The transmit signal pins may be arranged on one side of connector finger 206, and the receive signal pins may be arranged on the opposite side of connector finger 206. One differential-pair of signal pins 210 surrounded by a pair of ground pins 208 are visible in FIG. 4A. Additional pins (not shown) may be arranged on connector finger 206 for management signals or other suitable signals. Cable connector finger 206 may include a dielectric substrate material (e.g., FR4 PCB) and the signal pins may be gold plated contacts. The differential signal pins are electrically coupled to corresponding conductors 204 within cable connector 200. The ground pins may be combined and electrically coupled to a cable shield or corresponding ground conductors in a cable cord.

Figure 4B:
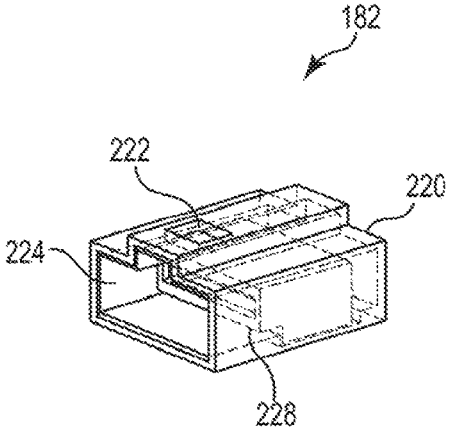
Figure 4C:
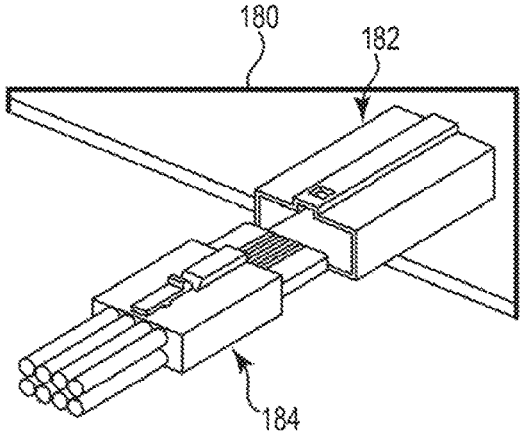
Figure 4D:
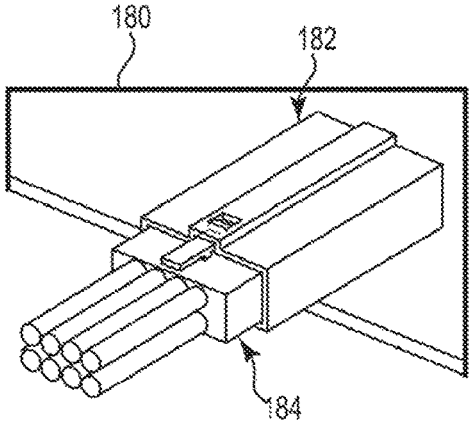

As illustrated in FIG. 4B, QX1 receptacle 182 includes a housing 220 and a receptacle connector bay 228 within the housing. Housing 220 includes a keyed bay opening 224 and a latch area 222 to ensure that a QX1 cable 184 is correctly oriented prior to installing into a QX1 receptacle as illustrated in FIG. 4C. Once installed in a QX1 receptacle 182 as illustrated in FIG. 4D, the connector finger 206 of QX1 cable 184 is within receptacle connector bay 228 such that the signal pins are electrically connected to corresponding signal lines of PCB 180 via contacts within QX1 receptacle 182.

Figure 5A:
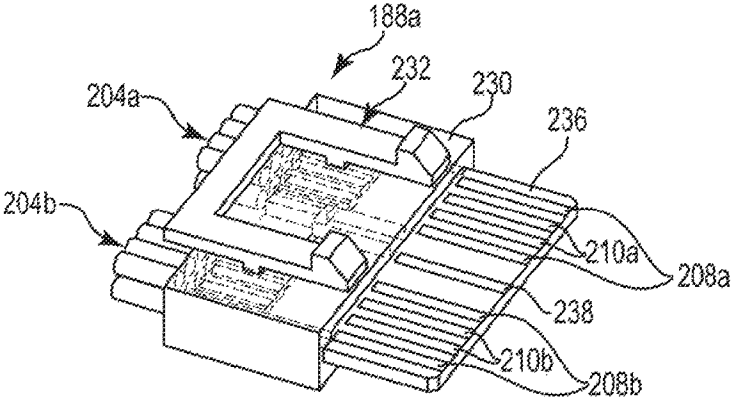
FIGS. 5A-5D illustrate example QX2 cables and QX2 receptacles.

FIGS. 5A-5D illustrate example QX2 cables and QX2 receptacles. As illustrated in FIG. 5A, QX2 cable 188*a* includes a cable connector 230, a latch 232, cable conductors 204*a* and 204*b*, and a cable connector finger 236. Cable conductors 204*a* and 204*b* are combined within a cable cord (not shown) of the QX2 cable. Latch 232 is attached to cable connector 230 and includes two levers that are linked to each other such that one motion will actuate both levers. Latch 232 ensures positive retention of QX2 cable 188*a* in QX2 receptacle 186*a* when the cable is installed, and allows easy removal of the cable from QX2 receptacle 186*a*. Cable connector finger 236 is supported by cable connector 230 and includes two signal lanes (i.e., 2-lane). Two differential-pairs of signal pins 210*a* and 210*b* surrounded by a pair of ground pins 208*a* and 208*b*, respectively, are visible in FIG. 5A. Additional pins (e.g. pin 238) may be arranged on connector finger 236 in the joint area for management signals or for other suitable signals.

Figure 5B:
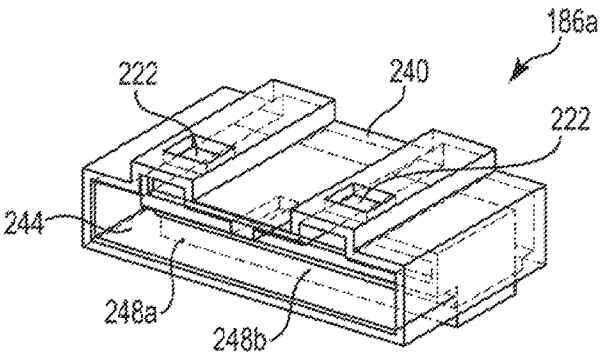
Figure 5C:
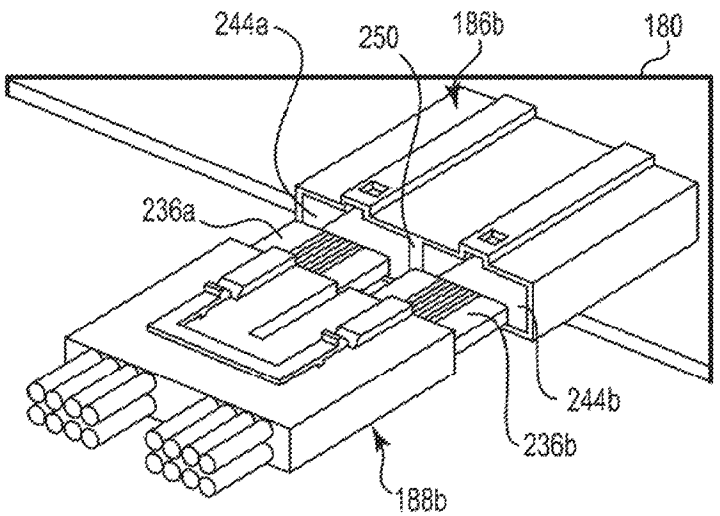

A QX2 cable connector may have one "joint" finger, as illustrated in FIG. 5A, or two "split" fingers, as illustrated in FIG. 5C. FIG. 5C illustrates an example of a QX2 cable 188*b* having split fingers 236*a* and 236*b*. A QX2 receptacle may support one QX2 cable or two QX1 cables. A QX2 receptacle may not have a divider wall, as illustrated by QX2 receptacle 186*a* in FIG. 5B, allowing either a joint-type QX2 cable or a split-type QX2 cable to be installed. Alternatively, a QX2 receptacle may have a divider wall 250, as illustrated by QX2 receptacle 186*b* in FIG. 5C, allowing a split-type QX2 cable to be installed, but not allowing a joint-type QX2 cable to be installed.

FIG. 5B illustrates an example QX2 receptacle 186*a* without a divider wall. QX2 receptacle 186*a* includes a housing 240 and two receptacle connector bays 248*a* and 248*b* within the housing. In this example, the two receptacle connector bays 248*a* and 248*b* are connected such that joint connector finger 236 (FIG. 5A) or split connector fingers 236*a* and 236*b* (FIG. 5C) may be inserted into the connector bays. In another example illustrated by QX2 receptacle 186*b* in FIG. 5C, a divider wall 250 divides the two receptacle connector bays 248*a* and 248*b* such that split connector fingers 236*a* and 236*b* may be inserted into the connector bays, respectively, but a joint connector finger 236 may not be inserted into the connector bays. Housing 240 includes a keyed bay opening 241 and latch areas 222 to ensure that a QX2 cable 188 is correctly oriented prior to installing into a QX2 receptacle as illustrated in FIG. 5C.

Figure 5D:
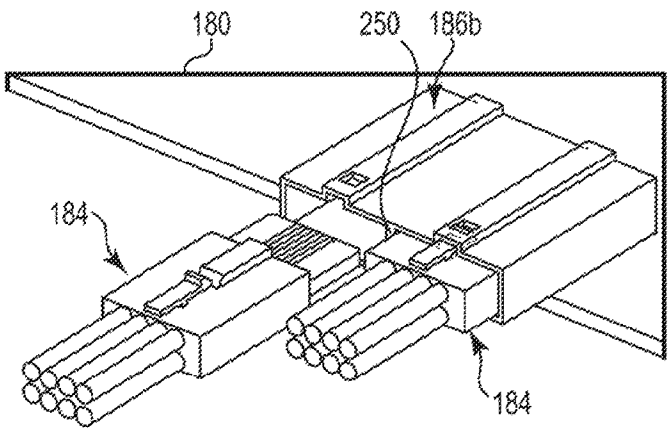

FIG. 5D illustrates one example of connecting two QX1 cables 184 to QX2 receptacle 186*b*. Once installed in a QX2 receptacle as illustrated in FIG. 5D, the connector finger of each of the QX cables is within the respective receptacle connector bay 248*a* and 248*b* such that the signal pins are electrically connected to corresponding signal lines of PCB 180 via contacts within QX2 receptacle 186*b*. The divider wall 250 may provide EMI shielding when only one QX1 cable 184 is installed in a QX2 receptacle 186*b*.

Figure 6B:
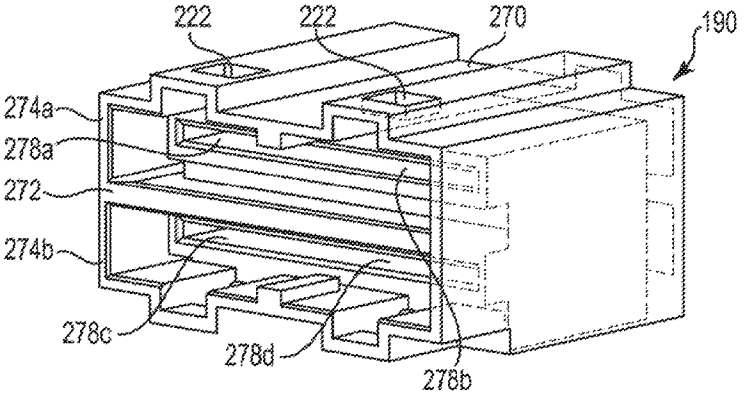
FIGS. 6A-6D illustrate an example QX4 cable and an example QX4 receptacle.
Figure 6A:
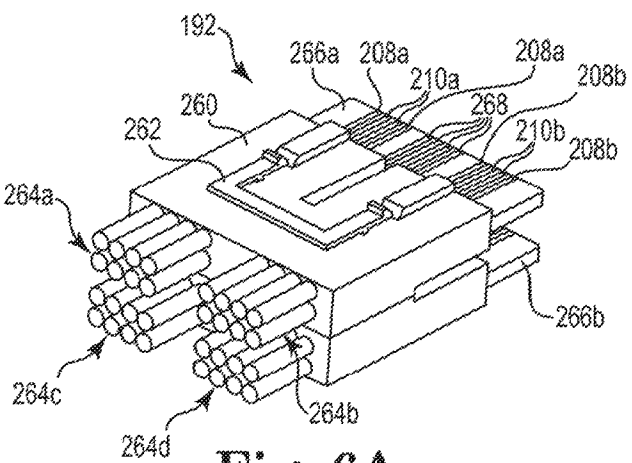

FIGS. 6A-6D illustrate an example QX4 cable and an example QX4 receptacle. As illustrated in FIG. 6A, QX4 cable 192 includes a cable connector 260, a latch 262, cable conductors 264*a*-264*d*, and joint cable connector fingers 266*a* and 266*b*. In other examples, cable connector fingers 266*a* and 266*b* may include split connector fingers as previously described and illustrated with reference to FIG. 5C. Cable conductors 264*a*-264*d* may be combined within a cable cord (not shown) of the QX4 cable.

Latch 262 is attached to cable connector 260 and includes two levers that are linked such that one motion will actuate both levers. In another example, a second latch may be arranged on the opposite side of housing 260 of cable connector 260. Latch 262 ensures positive retention of QX4 cable 192 in QX4 receptacle 190 when the cable is installed, and allows easy removal of the cable from QX4 receptacle 190. Cable connector fingers 266*a* and 266*b* are supported by cable connector 260 and include four signal lanes (i.e., 4-lane). Two differential-pairs of signal pins 210*a* and 210*b* surrounded by a pair of ground pins 208*a* and 208*b*, respectively, are visible in FIG. 6A. Additional pins (e.g. pins 268) may be arranged on connector fingers 266*a* and/or 266*b* in the joint area for management signals or for other suitable signals. The ground pins may be longer than the differential signal and additional pins.

FIG. 6B illustrates an example QX4 receptacle 190. A QX4 receptacle may support one QX4 cable, two QX2 cables, or four QX1 cables. QX4 receptacle 190 includes a housing 270 and four receptacle connector bays 278*a*-278*d* within the housing. In this example, receptacle connector bays 278*a* and 278*b* are connected such that a joint connector finger 266*a* or split connector fingers may be inserted into the connector bays. Receptacle connector bays 278*c* and 278*d* are also connected such that a joint connector finger 266*b* or split connector fingers may be inserted into the connector bays. In another example, a divider wall divides receptacle connector bays 278*a* and 278*b* and receptacle connector bays 278*c* and 278*d* such that split connector fingers may be inserted into the connector bays, but joint connector fingers may not be inserted into the connector bays.

Figure 6D:
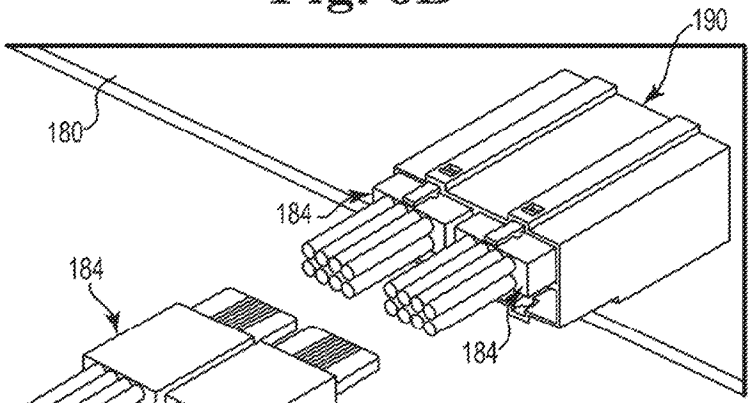
Figure 6D:
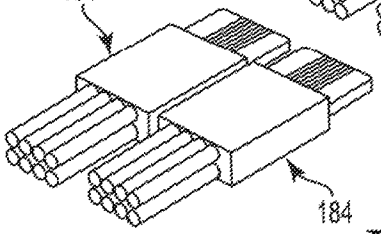
Figure 6C:
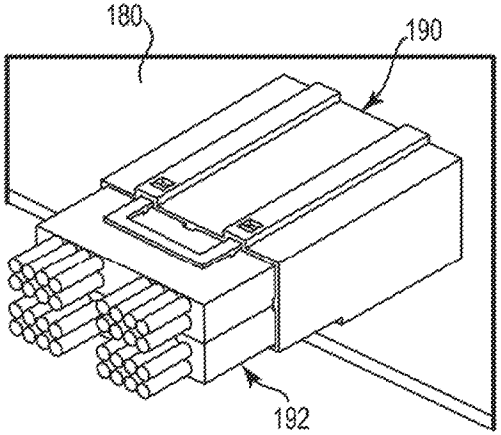

Housing 270 includes keyed bay openings 274*a* and 278*b* separated by a divider 272. Housing 270 also includes latch areas 222 to ensure that a QX4 cable 192, QX2 cable 188, or a QX1 cable 184 is correctly oriented prior to installing into a QX4 receptacle as illustrated in FIGS. 6C and 6D. Two latch areas 222 (Le., one for bay 278*a* and one for bay 278*b*) are shown in FIG. 6B, however, two additional latch areas 222 are arranged on the opposite side of housing 270 (Le., one for bay 278*c* and one for bay 278*d*). Accordingly, a QX1 or QX2 cable inserted into a lower receptacle connector bay 278*c* and/or 278*d* is flipped 180 degrees with respect to a QX1 or QX2 cable inserted into an upper receptacle connector bay 278*a* and/or 278*b*.

FIG. 6D illustrates one example of connecting four QX1 cables 184 to QX4 receptacle 190. Once installed in a QX4 receptacle as illustrated in FIG. 6D, the connector finger of each of the QX1 cables is within the respective receptacle connector bay 278*a*-278*d* such that the signal pins are electrically connected to corresponding signal lines of PCB 180 via contacts of QX4 receptacle 190. While FIGS. 6A-6D illustrate 4-lane cables and 4-lane receptacles having a 2×2 configuration, in other examples, the 4-lane cables and 4-lane receptacles may have a 1×4 configuration (i.e., arranged in one plane).

Figure 7A:
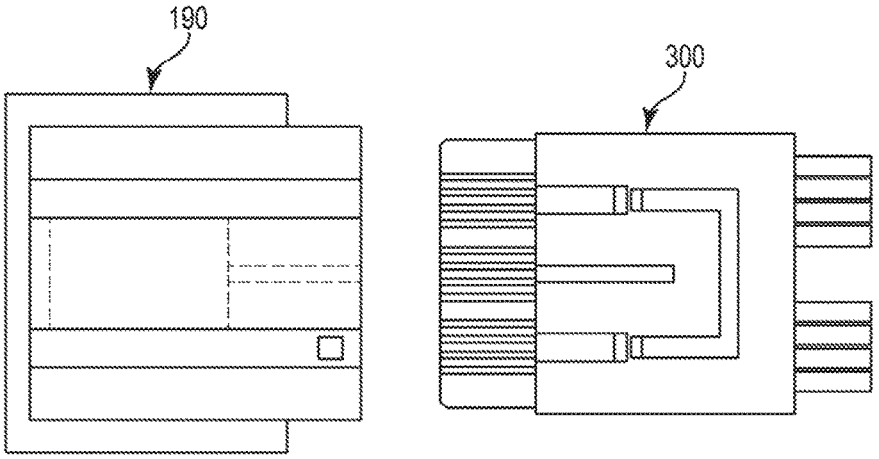
FIGS. 7A-7C illustrate top views of an example QX4 receptacle with example QX4, QX2, and QX1 cables.
Figure 7B:
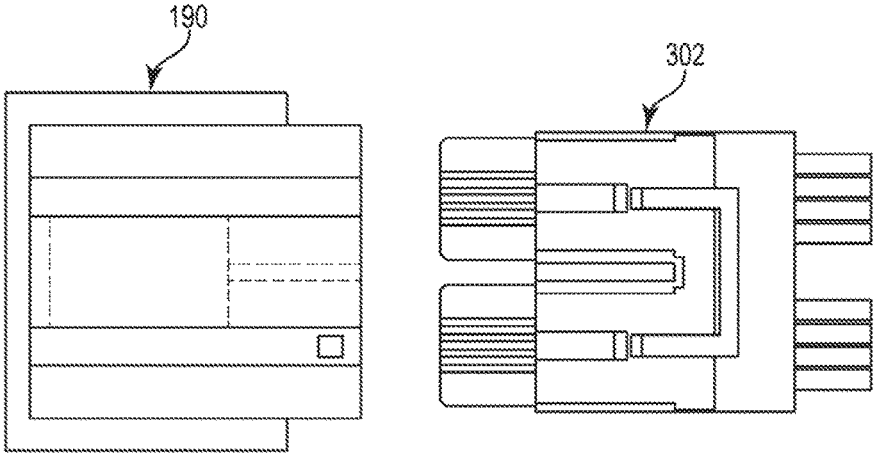
Figure 7C:
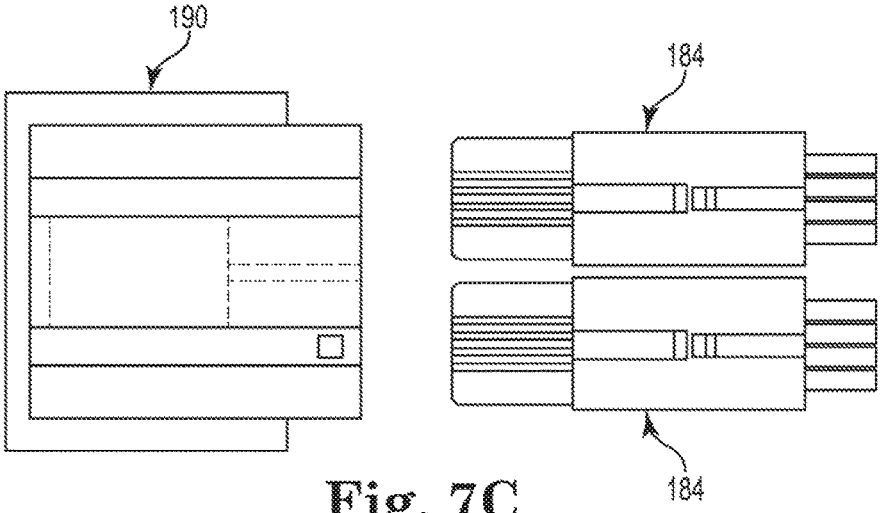

FIGS. 7A-7C illustrate top views of an example QX4 receptacle 190 with example QX4, QX2, and QX1 cables. FIG. 7A illustrates a joint finger QX cable 300 useable with QX4 receptacle 190. Joint finger QX cable 300 may be a QX2 cable 188*a* (FIG. 5A) or a QX4 cable 192 (FIG. 6A). FIG. 7B illustrates a split finger QX cable 302 useable with QX4 receptacle 190. Split finger QX cable 302 may be a QX2 cable 188*b* (FIG. 5C) or a split finger QX4 cable. FIG. 7C illustrates QX1 cables 184 useable with QX4 receptacle 190. Therefore, the same QX4 receptacle may be used with a QX4 cable, two QX2 cables, or four QX1 cables.

Figure 8B:
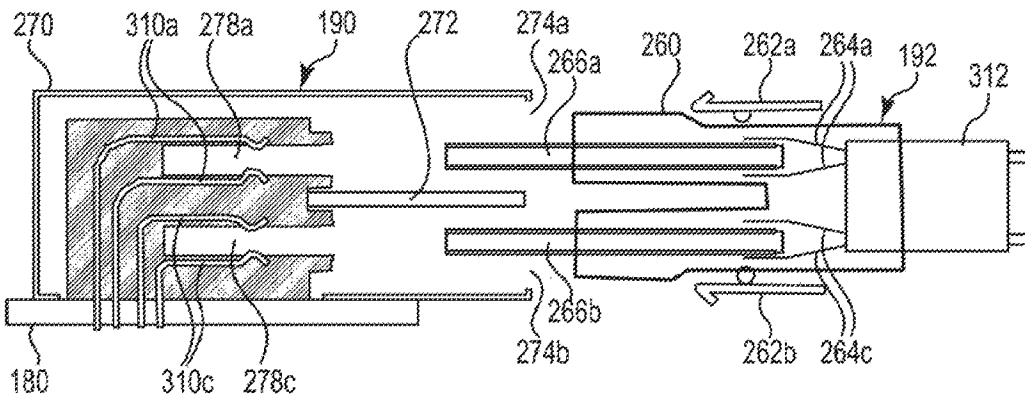
FIG. 8A illustrates a front view of a QX4 receptacle and FIGS. 8B-8D illustrate cross-sectional views of a QX4 receptacle with example QX4, QX2, and QX1 cables.
Figure 8A:
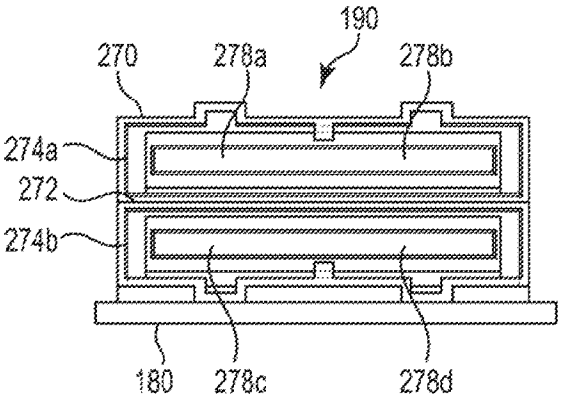
Figure 8C:
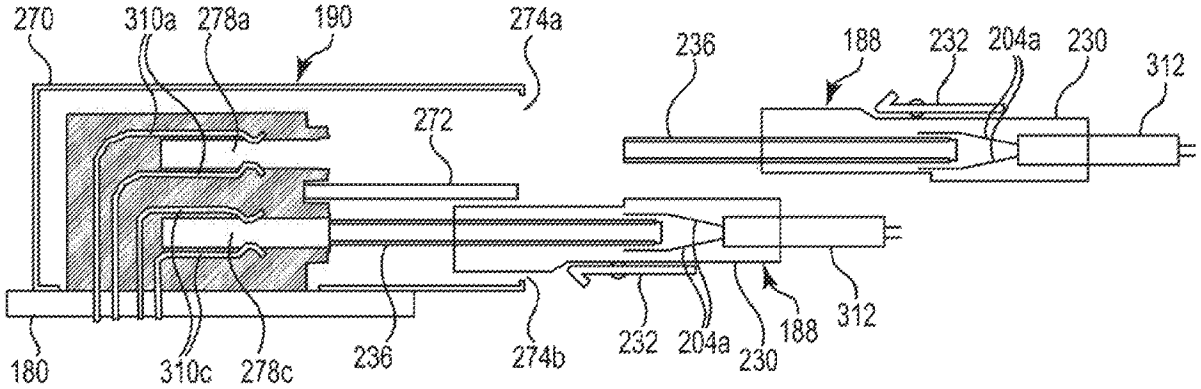
Figure 8D:
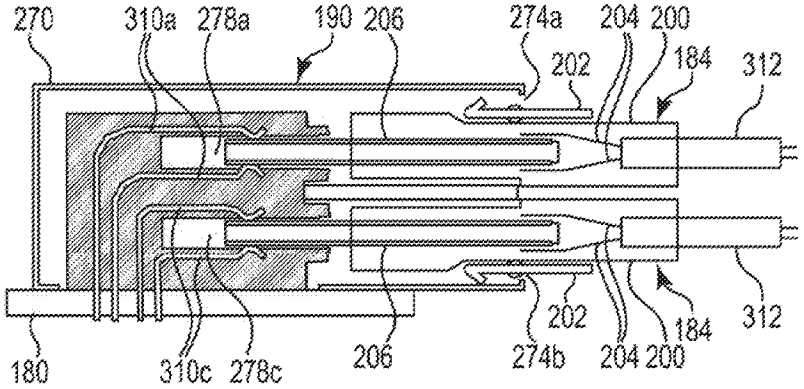

FIG. 8A illustrates a front view of QX4 receptacle 190 and FIGS. 8B-8D illustrate cross-sectional views of QX4 receptacle 190 with example QX4, QX2, and QX1 cables. As previously described with reference to FIG. 6B, QX4 receptacle 190 in FIG. 8A includes receptacle connector bays 278*a* and 278*b* in the upper joint bay and receptacle connector bays 278*c* and 278*d* in the lower joint bay.

FIG. 8B illustrates a cross-sectional view of one example of a QX4 cable 192 being inserted into QX4 receptacle 190. QX4 receptacle 190 includes contacts 310*a* in receptacle bay 278*a* and contacts 310*c* in receptacle bay 2'78*c*. Contacts 310*a* contact signal pins on connector finger 266*a* and contacts 310*c* contact signal pins on connector finger 266*b* when QX4 cable 192 is installed in QX4 receptacle 190. Contacts 310*a* and 310*c* are electrically coupled to corresponding signal lines in PCB 180. The signal pins on connector finger 266*a* are electrically coupled to signal conductors 264*a*. The signal pins on connector finger 266*b* are electrically coupled to signal conductors 264*c*. The signal conductors 264*a* and 264*c* are bundled into a cable cord 312. In this example, QX4 cable 192 includes a latch 262*a* on the upper side of housing 260 and a latch 262*b* on the lower side of housing 260. In other examples, QX4 cable 192 includes one latch 262*a* or 262*b* and excludes the other.

FIG. 8C illustrates a cross-sectional view of one example of two QX2 cables 188 being inserted into QX4 receptacle 190. Contacts 310*a* of QX4 receptacle 190 contact signal pins on connector finger 236 of a first QX2 cable 188 and contacts 310*c* contact signal pins on connector finger 236 of a second QX2 cable when QX2 cables 188 are installed in QX4 receptacle 190. The signal pins on each connector finger 236 are electrically coupled to signal conductors 204*a*. The signal conductors 204*a* of each cable are bundled into a cable cord 312. The second QX2 cable is flipped 180 degrees with respect to the first QX2 cable so that the latch 232 of the second QX2 cable is opposite to the latch 232 of the first QX2 cable.

FIG. 8D illustrates a cross-sectional view of one example of two QX1 cables 184 inserted in QX4 receptacle 190. Contacts 310*a* of QX4 receptacle 190 contact signal pins on connector finger 206 of a first QX1 cable 184 and contacts 310*c* contact signal pins on connector finger 206 of a second QX1 cable when the QX1 cables are installed in QX4 receptacle 190. The signal pins on each connector finger 206 are electrically coupled to signal conductors 204. The signal conductors 204 of each cable are bundled into a cable cord 312. The second QX1 cable is flipped 180 degrees with respect to the first QX1 cable so that the latch 202 of the second QX1 cable is opposite to the latch 202 of the first QX1 cable.

Figure 9A:
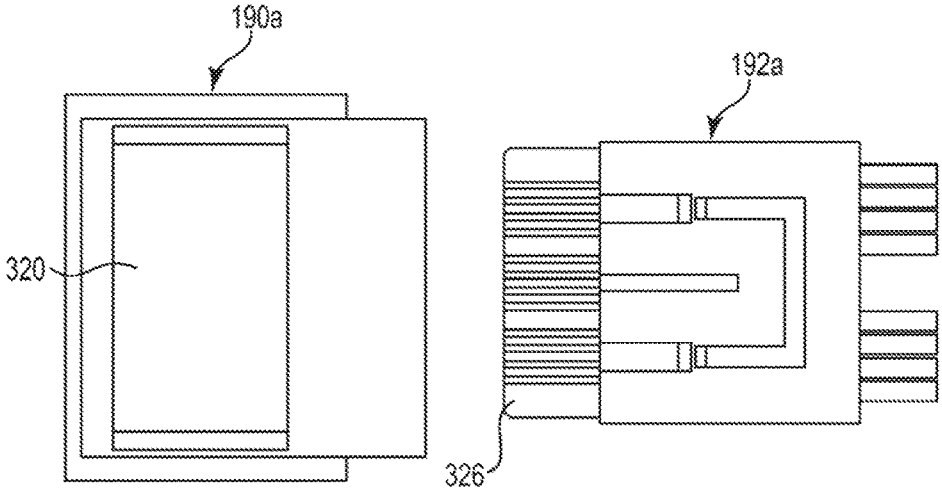
FIGS. 9A-9C illustrate top views of example QX4 receptacles with example QX4 cables.
Figure 9B:
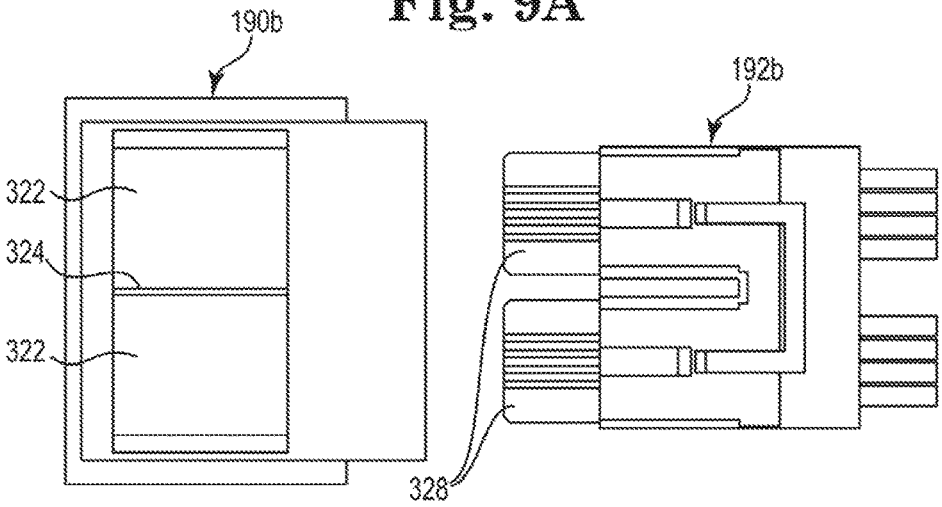
Figure 9C:
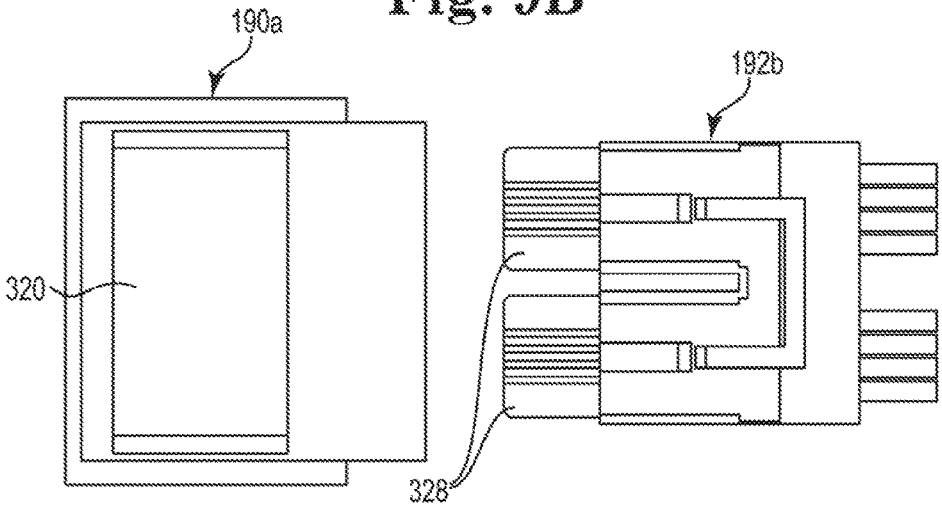

FIGS. 9A-9C illustrate top views of example QX4 receptacles with example QX4 cables. FIG. 9A illustrates one example of a QX4 receptacle 190*a* having joint bays 320. A joint bay 320 includes two receptacle bays 278*a* and 278*b* or 278*c* and 278*d* as previously described and illustrated with reference to FIG. 6B. As used herein, a QX receptacle having joint bays is referred to as a QXj receptacle (i.e., QX4j receptacle or QX2j receptacle). The joint bays 320 are useable with joint fingers 326 of a QX4 cable 192*a*. As used herein, a QX cable have a joint finger is referred to as a QXj cable (i.e., QX4j cable or QX2j cable).

FIG. 98 illustrates one example of a QX4 receptacle 190*b* having split bays 322. As used herein, a QX receptacle having split bays is referred to as a QXs receptacle (i.e., QX4s receptacle or QX2s receptacle). Split bays 322 are divided by a wall 324. The split bays 322 are useable with split fingers 328 of a QX4 cable 192*b*. As used herein, a QX cable have split fingers is referred to as a QXs cable (i.e., QX4s cable or QX2s cable). FIG. 9C illustrates one example of a QX4j receptacle 190*a* with a QX4s cable 192*b*.

Figures 10, 11:
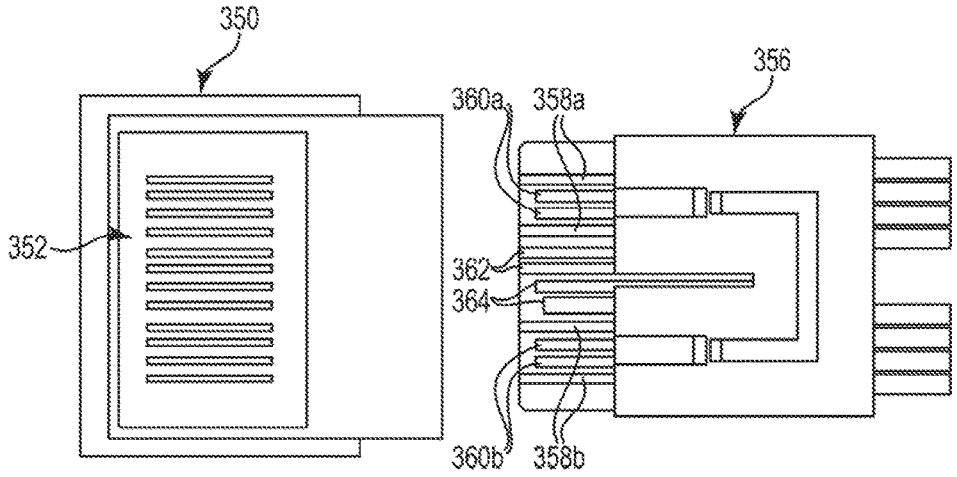
FIG. 10 is a table illustrating the interoperability among joint-type and split-type QX2 and QX4 receptacles and cables.
FIG. 11 illustrates a top view of one example of a QX4 or QX2 receptacle and a QX4 or QX2 cable.

FIG. 10 is a table 340 illustrating the interoperability among joint-type and split-type QX2 and QX4 receptacles and cables. As shown in table 340, a QX1 cable can be used with a QX1, QX2j, QX2s, QX4j, or QX4s receptacle. A QX2j cable can be used with a QX2j or QX4j receptacle. A QX2s cable can be used with a QX2j, QX2s, QX4j, or QX4s receptacle, A QX4j cable can be used with a QX4j receptacle, and a QX4s cable can be used with a QX4j or QX4s receptacle.

FIG. 11 illustrates a top view of one example of a QX4 or QX2 receptacle 350 and a QX4 or QX2 cable 356. QX4 or QX2 receptacle 350 includes receptacle connector contacts 352. QX4 or QX2 cable 356 includes ground pins 358*a* and 358*b*, differential signal pins 360*a* and 360*b*, management signal pins 362, and power pins 364. Each receptacle connector contact 352 corresponds to one of ground pins 358*a* and 358*b*, differential signal pins 360*a* and 360*b*, management signal pins 362, and power pins 364. Receptacle connector contacts 352 electrically couple each of the ground pins 358*a* and 358*b*, differential signal pins 360*a* and 360*b*, management signal pins 362, and power pins 364 to corresponding ground, signal lines, and power of a PCB. The pin lengths may be the same or different. For example, ground pins 358*a* and 358*b* and management pins 362 may be longer than differential signal pins 360*a* and 360*b* and power pins 364.

Figure 12:
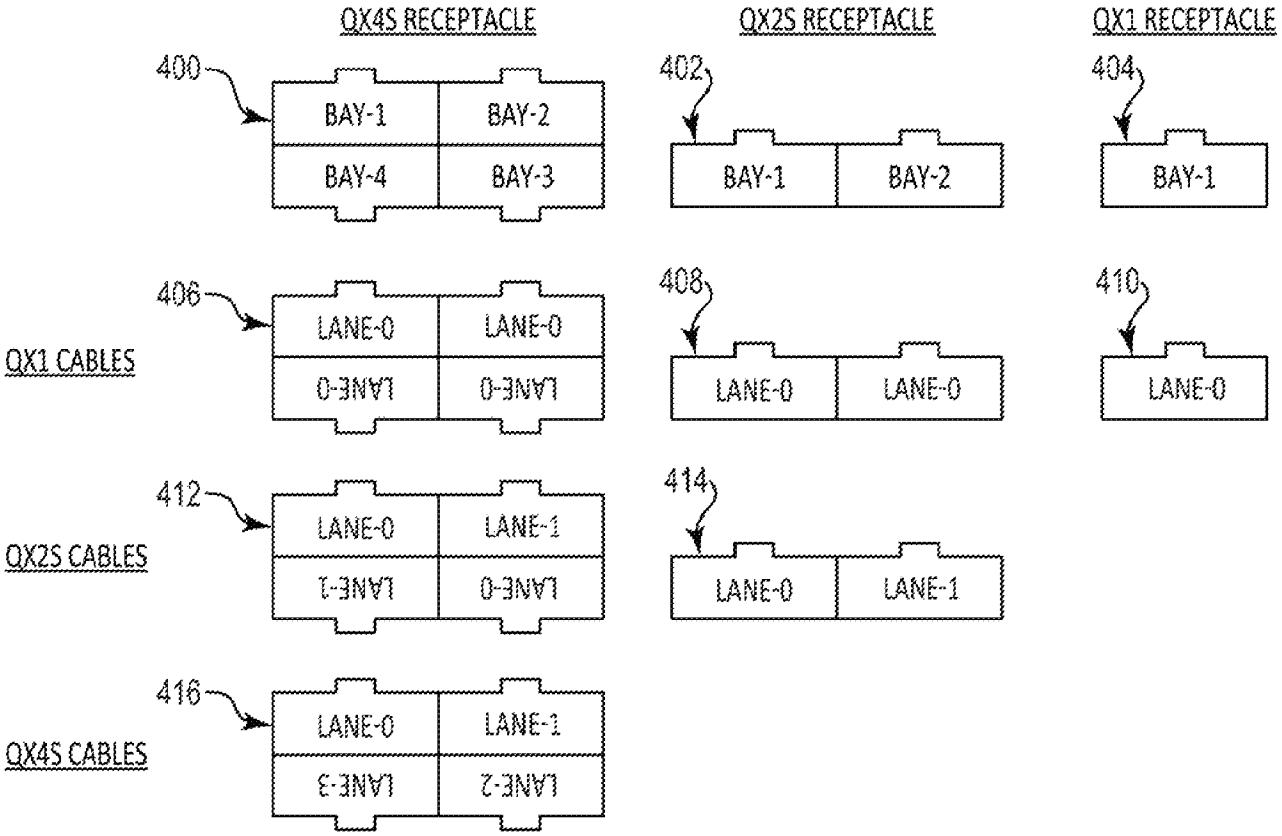
FIG. 12 illustrates example bay and lane assignments for split-type QX receptacles and cables.

FIG. 12 illustrates one example of bay and lane assignments for QX split-type receptacles and cables. A QX4s receptacle as indicated at 400 has four split bays including bay-1 in the upper left, bay-2 in the upper right, bay-3 in the lower right, and bay-4 in the lower left. When using QX1 cables with a QX4s receptacle as indicated at 406, each of the four bays are assigned lane-0 such that a network chip is configured for up to four 1-lane ports. When using QX2s cables with a QX4s receptacle as indicated at 412, bay-1 and bay-2 are assigned lane-0 and lane-1, respectively, and bay-3 and bay-4 are assigned lane-0 and lane-1, respectively, such that a network chip is configured for up to two 2-lane ports. When using a QX4s cable with a QX4s receptacle as indicated at 416, bay-1 is assigned lane-0, bay-2 is assigned lane-1, bay-3 is assigned lane-2, and bay-4 is assigned lane-3 such that a network chip is configured for one 4-lane port.

A QX2s receptacle as indicated at 402 has two split bays including bay-1 in the left and bay-2 in the right. When using QX1 cables with a QX2s receptacle as indicated at 408, each of the two bays are assigned lane-0 such that a network chip is configured for up to two 1-lane ports. When using QX2s cables with a QX2s receptacle as indicated at 414, bay-1 is assigned lane-0 and bay-2 is assigned lane-1 such that a network chip is configured for one 2-lane port. A QX1 receptacle as indicated at 404 has one bay (Le., bay-1), which is assigned lane-0 as indicated at 410 for use with a QX1 cable such that a network chip is configured for one 1-lane port.

Figure 13:
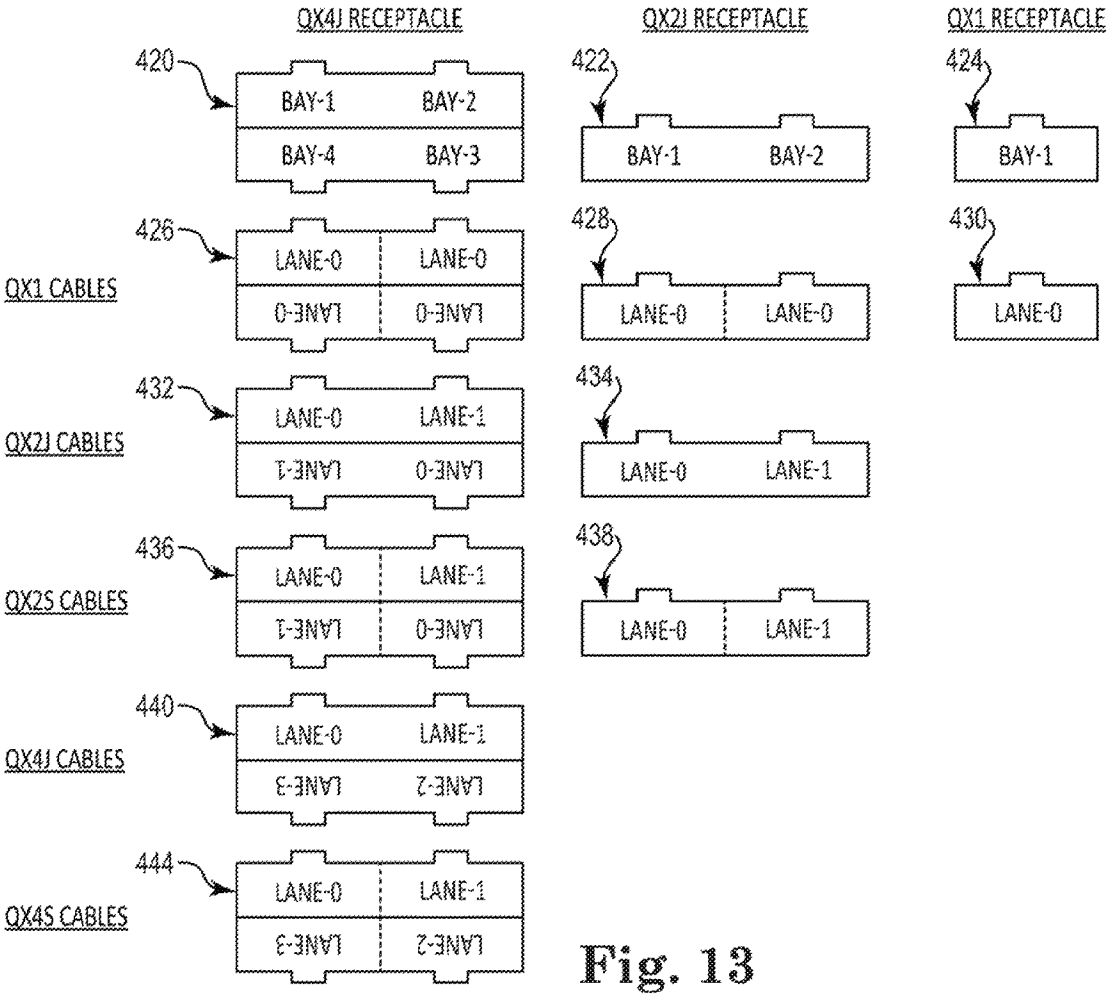
FIG. 13 illustrates example bay and lane assignments for joint-type QX receptacles and cables.

FIG. 13 illustrates example bay and lane assignments for QX joint-type receptacles and cables. A QX4j receptacle as indicated at 420 has two joint bays providing four total bays including bay-1 in the upper left, bay-2 in the upper right, bay-3 in the lower right, and bay-4 in the lower left, Bay-1 and bay-2 provide a first joint bay, and bay-3 and bay-4 provide a second joint bay. When using QX1 cables with a QX4j receptacle as indicated at 426, each of the four bays are assigned lane-0 such that a network chip is configured for up to four 1-lane ports. When using QX2j or QX2s cables with a QX4j receptacle as indicated at 432 and 436, respectively, bay-1 and bay-2 are assigned lane-0 and lane-1, respectively, and bay-3 and bay-4 are assigned lane-0 and lane-1, respectively, such that a network chip is configured for up to two 2-lane ports. When using a QX4j cable or QX4s cable with a QX4j receptacle as indicated at 440 and 444, respectively, bay-1 is assigned lane-0, bay-2 is assigned lane-1, bay-3 is assigned lane-2, and bay-4 is assigned lane-3 such that a network chip is configured for one 4-lane port.

A QX2j receptacle as indicated at 422 has one joint bay providing two total bays including bay-1 in the left and bay-2 in the right. When using QX1 cables with a QX2j receptacle as indicated at 428, each of the two bays are assigned lane-0 such that a network chip is configured for up to two 1-lane ports. When using QX2j or QX2s cables with a QX2j receptacle as indicated at 434 and 438, respectively, bay-1 is assigned lane-0 and bay-2 is assigned lane-1 such that a network chip is configured for one 2-lane port. A QX1 receptacle as indicated at 424 has one bay (i.e., bay-1), which is assigned lane-0 as indicated at 430 for use with a QX1 cable such that a network chip is configured for one 1-lane port.

Figure 14:
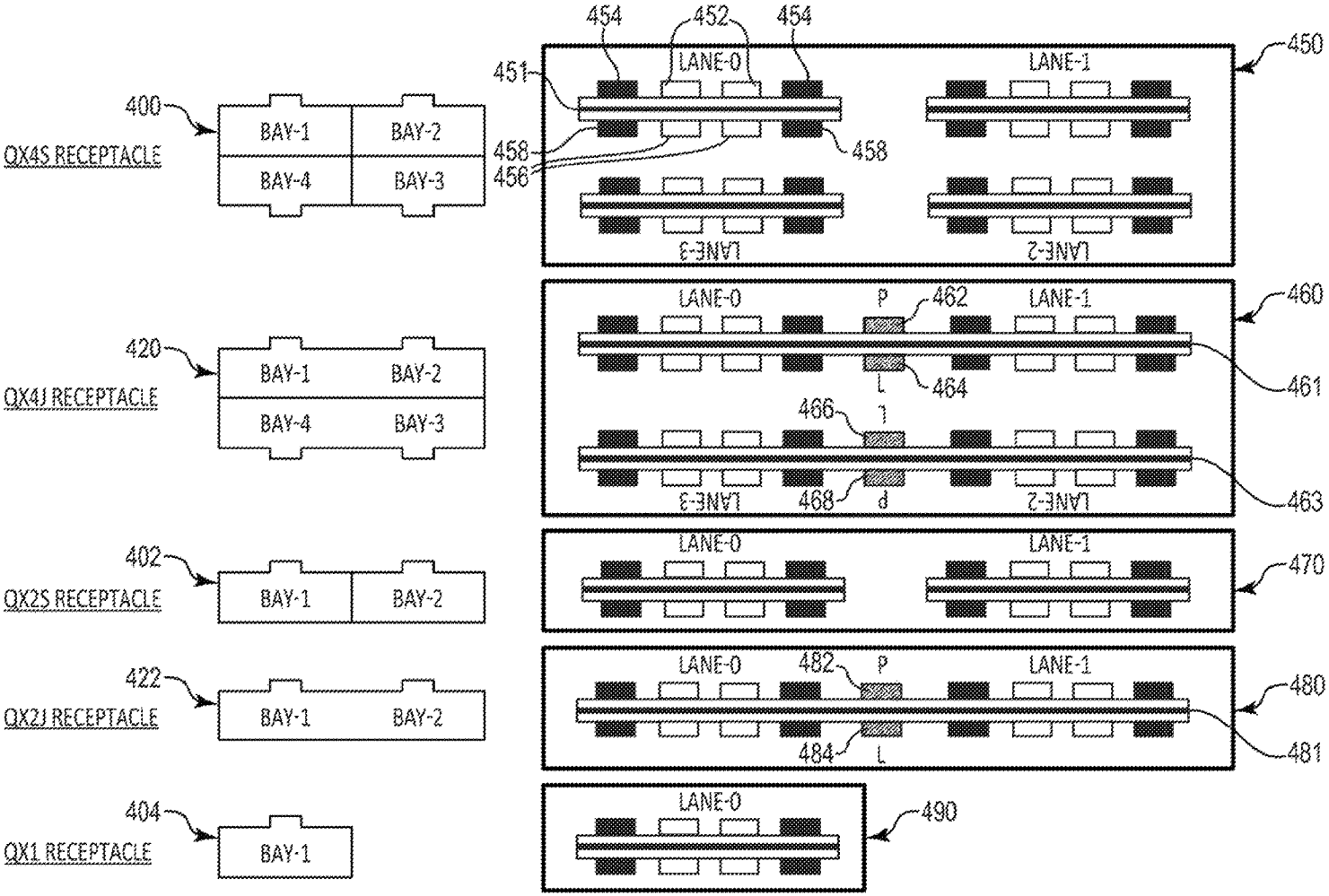
FIG. 14 illustrates example signal assignments in QX receptacle bays.

FIG. 14 illustrates example signal assignments in QX receptacle bays and cables. A QX4s cable as indicated at 450 is usable with QX4s receptacle 400. A QX4j cable as indicated at 460 is usable with QX4j receptacle 420. A QX2s cable as indicated at 470 is usable with QX2s receptacle 402. A QX2j cable as indicated at 480 is usable with QX2j receptacle 422. A QX1 cable as indicated at 490 is usable with QX1 receptacle 404. The lane assignments for each cable 450, 460, 470, and 480 correspond to the lane assignments previously described and illustrated with reference to FIGS. 12 and 13.

Each connector finger (whether a split finger as indicated at 450 or part of a joint finger as indicated at 460) includes two pairs of differential signal lines, one pair for transmit signals and another pair for receive signals. For example, a first side of connector finger 451 of QX4s cable 450 includes first differential signal pins 452 surrounded by ground pins 454, and a second side of connector finger 451 opposite to the first side includes second differential signal pins 456 surrounded by ground pins 458.

The QX4j and QX2j cables indicated at 460 and 480, respectively, may include a Presence (P) signal pin to provide a P signal to signify that an adjacent lane is present, and a Low (L) signal pin to provide an L signal to signify that the row contains the lane-0. These P and L signals are detected by a system manager when a cable is installed in a receptacle. Based on these signals, the system manager configures the network chip to provide a 1-lane, 2-lane, or 4-lane port corresponding to the installed cable. In one example, the P and L signal pins interface with corresponding receptacle contacts such that no cable conductors are used to communicate these signals across a cable.

QX4j cable 460 includes a P signal pin and an L signal pin on each joint connector finger 461 and 463. The upper connector finger 461 includes a P signal pin 462 on one side of the connector finger in the joint region and an L signal pin 464 on the opposite side of the connector finger in the joint region. The lower connector finger 463 includes an L signal pin 466 on one side of the connector finger in the joint region and a P signal pin 468 on the opposite side of the connector finger in the joint region. QX2j cable 480 includes a P signal pin 482 on one side of connector finger 481 in the joint region and an L signal pin 484 on the opposite side of connector finger 481 in the joint region.

The split-type receptacles 400 and 402 and cables 450 and 470 do not have P and L signal contacts and corresponding P and L signal pins in this example, respectively. Therefore, to dynamically detect whether a wider than one lane port is supported by an installed cable, in one example the network chips go through an auto negotiation phase to determine the lane width of the installed cable.

For a QX2j receptacle, when two QX1 cables are installed, there are no P or L signal connections. In one example, when a QX2s cable is installed, there are also no P or L signal connections. Within a QX2j cable, however, both the P and the L signal pins are connected to ground (e.g., to a ground pin or a ground plane). When a QX2j cable is installed, the system manager can detect a2-lane cable and send appropriate messages to configure the network chip for lane-0 and lane-1, for the QX2j receptacle.

For a QX4j receptacle, when four QX1 cables are installed there are no P or L signal connections. In one example, when two QX2s or one QX4s cable is installed, there are also no P or L signal connections. When a QX2j cable is installed in the top or the bottom joint bay, the system manager can detect a2-lane cable and send appropriate messages to configure the network chip for lane-0 and lane-1, for the QX4j receptacle top or bottom joint bay, respectively. When two QX2j cables are installed in the QX4j receptacle, the system manager can detect two 2-lane cables are installed by sensing that both P and L signals for both joint bays are connected to ground. As previously described, there are ground pins on each cable connector finger surrounding the differential signal pins. The P and/or L pins may be coupled to these ground pins. Within a QX4j cable, both the P and the L signals in the top joint bay are connected to ground, but only the P signal in the bottom bay is connected to ground. When a QX4j cable is installed, the system manager can detect a 4-lane cable by sensing that both P signals and one L signal are connected to ground, and subsequently send appropriate messages to configure the network chip for lane-0, lane-1, lane-2, and lane-3 for the QX4j receptacle.

FIG. 15 is a table 500 illustrating the signal combinations to detect cable types installed in a QX2j receptacle. As indicated in table 500, the P and L signals for QX1 cables and QX2s cables installed in a QX2j receptacle are not connected to ground since the P and L signal pins may not exist for QX1 and Qx2s cables. The P and L signals for a QX2j cable installed in a QX2j receptacle are both connected to ground. Therefore, the system manager recognizes that a QX2j cable is installed and sends appropriate messages to configure the network chip for a 2-lane port.

FIG. 16 is a table 502 illustrating the signal combinations to detect cable types in a QX4j receptacle. As indicated in table 502, the top and bottom P and L signals for QX1 cables, QX2s cables, and QX4s cables installed in a QX4j receptacle are not connected to ground since the P and L signal pins may not exist for QX1, QX2s, and QX4s cables. The P and L signals for each of two QX2j cables installed in the top and bottom joint bays, respectively, of a QX4j receptacle are each connected to ground. Therefore, the system manager recognizes that two QX2j cables are installed and sends appropriate messages to configure the network chip for two 2-lane ports. The top P and L signals and the bottom P signal are connected to ground and the bottom L signal is not connected to ground for a QX4j cable installed in a QX4j receptacle. Therefore, the system recognizes that a QX4j cable is installed and sends appropriate messages to configure the network chip for a 4-lane port.

Figure 17:
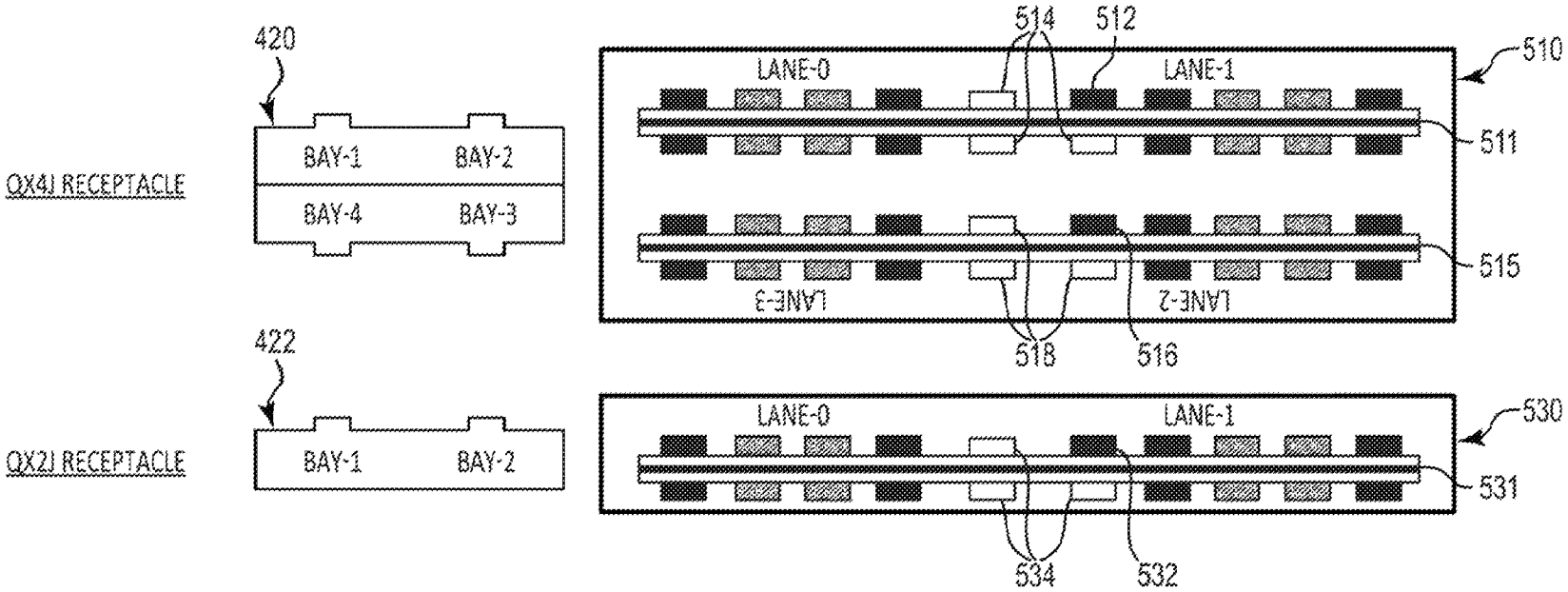
FIG. 17 illustrates example joint-type QX receptacle bays with additional management signal and power contacts.

FIG. 17 illustrates example QXj receptacle bays with additional management signal and power contacts. A QX4j cable 510 useable with a QX4j receptacle 420 includes a power pin 512 and a management signal pin 514 on one side of upper connector finger 511 and management signal pins 514 on the opposite side of upper connector finger 511. The QX4j cable 510 also includes a power pin 516 and a management signal pin 518 on one side of lower connector finger 515 and management signal pins 518 on the opposite side of lower connector finger 515. A QX2j cable 530 useable with a QX2j receptacle 422 includes a power pin 532 and a management signal pin 534 on one side of the connector finger 531 and management signal pins 534 on the opposite side of connector finger 531. In one example, the management signal and power pins can be used to support on-cable tag chips (e.g., EEPROM, RFID) or for other suitable purposes. In other examples, different numbers of management pins and/or power pins may be used on either side of the connector fingers, such as to support signal repeaters within a cable connector.

Figure 18:
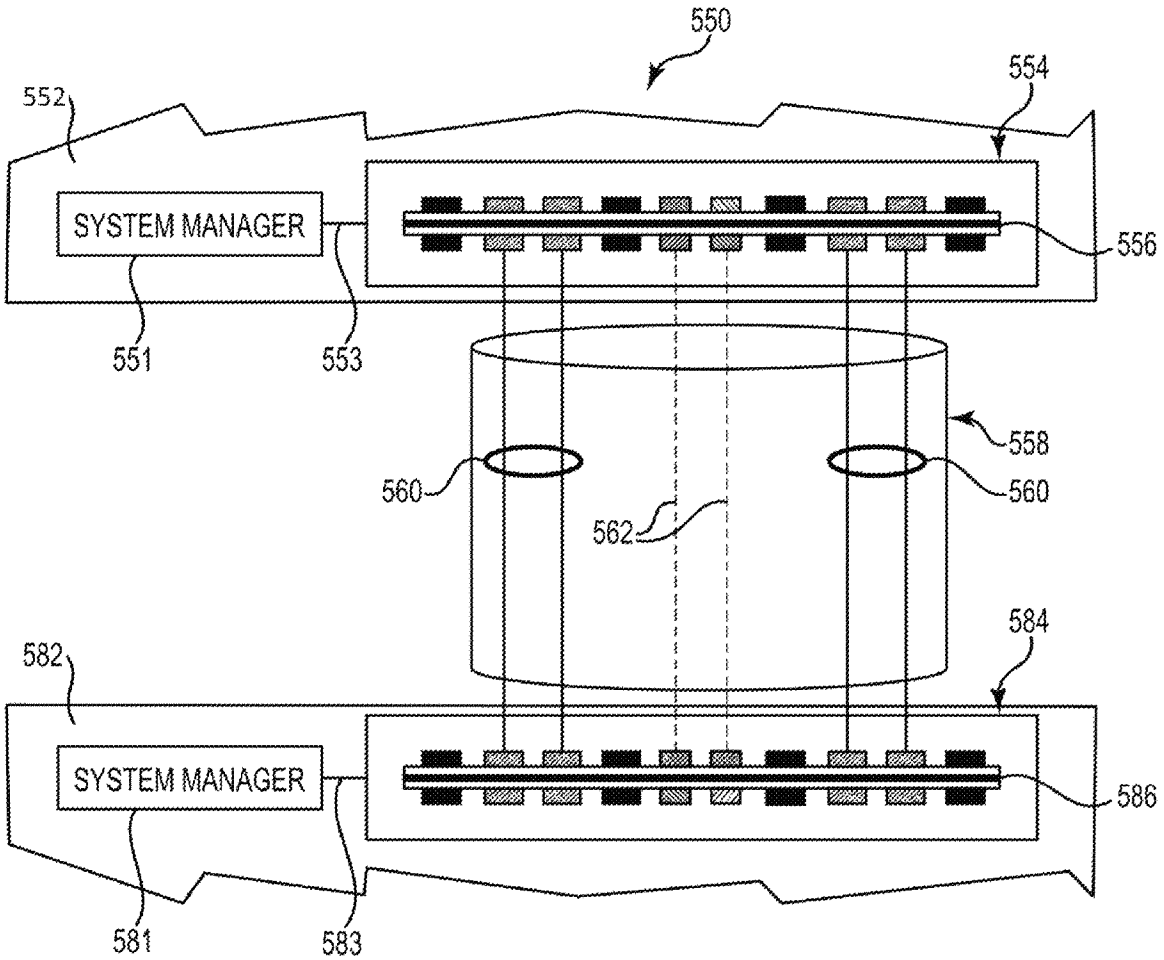
FIG. 18 illustrates one example of a system including management signals communicating across a cable.

FIG. 18 illustrates one example of a system 550 including management signals communicating across a cable. System 550 includes a first system 552 and a second system 582 First system 552 includes a system manager 551 and a QX2 receptacle 554. System manager 551 is communicatively coupled to QX2 receptacle 554 via a communication link 553. Second system 582 includes a system manager 581 and a QX2 receptacle 584. System manager 581 is communicatively coupled to QX2 receptacle 584 via a communication link 583, First system 552 is communicatively coupled to second system 582 via a QX2 cable 558. In addition to the differential signal lanes 560 for a network port, management signals 562 are transported along the cable so that system manager 551 in first system 552 and system manager 581 in second system 582 can communicate with each other independently of the signal transmission on the differential signal lanes 560. The actual number of additional contacts in the receptacles and corresponding pins on the connector fingers and the number of cable conductors within a cable for the management signals may vary depending on the implementation.

Figure 19:
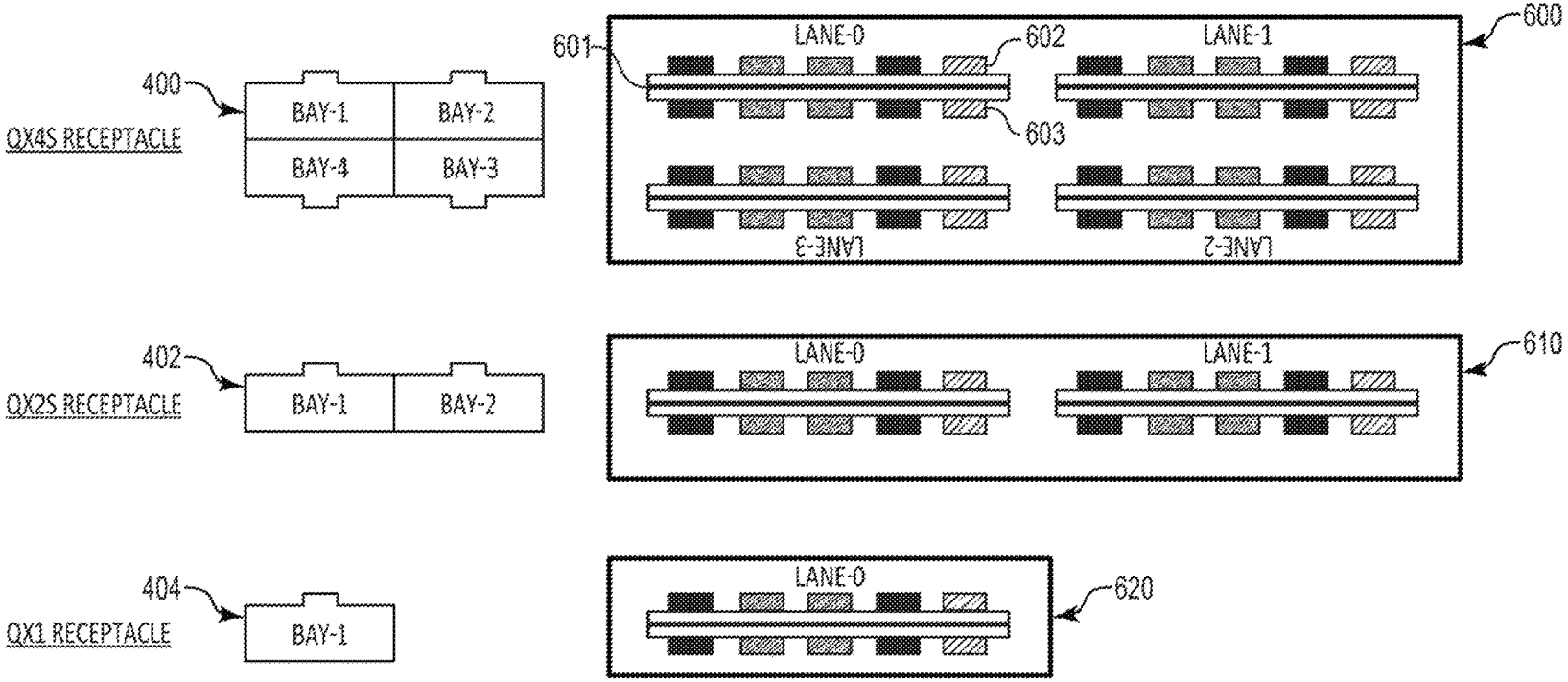
FIG. 19 illustrates examples of QX receptacle bays and cables having contacts for management signals.

FIG. 19 illustrates examples of QX receptacle bays and cables having contacts for management signals. In one example, the management signals are P and L signals. P and L signals or similar management type signals can be added to each bay so that even the 1-lane and the split-type cables can be auto-detected. The connector finger and the cable size, however, may be larger to accommodate the management signals for each lane, and when multiple lanes are used many of the management signals may not be used.

A QX4s cable 600 useable with QX4s receptacle 400, a QX2s cable 610 useable with a QX2s receptacle 401, and a QX1 cable usable with a QX1 receptacle 404 each include bays having management signal contacts. For example, connector finger 601 of QX4s cable 600 corresponding to bay-1 of QX4s receptacle 400 includes a management pin 602 on one side of the connector finger 601 and a management pin 603 on the opposite side of connector finger 601. Similarly, the contact assignment for the management pins is replicated in each bay of each QX4 receptacle 400, QX2 receptacle 402, and QX1 receptacle 404 and corresponding QX4 cable 600, QX2 cable 610, and QX1 cable 620. Since each bay has its own set of management signals, there is no joint area needed to provide the management signals. Although the connector width may be larger for this example, it might be acceptable for applications that desire QX1 to have management signals. Some of these management signals may be connected to cable conductors so that the system manager on one end of the cable can detect the presence of a system on the other end, or the two system managers across the cable can communicate with each other.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A system comprising:

a receptacle comprising a plurality of bays, each bay supporting 1-lane for differential transmit signals and differential receive signals, wherein at least two bays of the plurality of bays are to connect to one 2-lane joint connector finger cable including a joint finger with differential signal pair pins in a joint area of the joint finger, wherein the receptacle is to connect to a multi-lane cable to provide a multi-lane port or connect to a plurality of 1-lane cables to provide a plurality of 1-lane ports, wherein the joint bay comprises contacts to detect a type of cable installed based on whether the joint connector finger cable includes a present signal pin, the present signal pin to indicate an adjacent lane, and a low signal pin, to indicate that a lane in the multi-lane cable includes a lane-0.

2. The system of claim 1, wherein the receptacle has two bays, and wherein the receptacle is to connect to two 1-lane cables to provide two 1-lane ports or connect to one 2-lane cable to provide one 2-lane port.

3. The system of claim 1, wherein the receptacle has four bays, and wherein the receptacle is to connect to four 1-lane cables to provide four 1-lane ports, connect to two 2-lane cables to provide two 2-lane ports, or connect to one 4-lane cable to provide one 4-lane port.

4. The system of claim 1, wherein each bay of the receptacle comprises a latch area to receive a latch of a cable.

5. The system of claim 1, wherein the receptacle comprises a divider wall between adjacent bays.

6. A system comprising:

a receptacle comprising a joint bay, each bay of the joint bay supporting 1-lane of network communications, wherein the joint bay is to connect to at least one 2-lane joint connector finger cable including a joint finger with differential pair signal pins in a joint area of the joint finger, wherein the joint bay comprises contacts to detect a type of cable installed based on whether the joint connector finger cable includes a present signal pin, the present signal pin to indicate, based on a connection between the present signal pin and a ground pin, an adjacent lane, and a low signal pin, to indicate, based on a connection between the low signal pin and a ground pin, that a row in the multi-lane cable includes a lane-0.

7. The system of claim 6, wherein the joint bay comprises contacts in a joint region of the joint bay to support management signals, the contacts to connect to pins in a joint area of the 2-lane joint connector finger cable.

8. The system of claim 6, further comprising:

wherein the receptacle comprises a further joint bay; and a network chip communicatively coupled to the receptacle, the network chip to provide two 1-lane ports in response to two 1-lane cables being connected to the joint bay, to provide one 2-lane port in response to one 2-lane joint connector finger cable or one 2-lane split connector finger cable being connected to the joint bay, and to provide one 4-lane port in response to one 4-lane cable being connected to the joint bay and the further joint bay.

9. A system comprising:

a first system comprising a network chip communicatively coupled to a first receptacle including a plurality of bays, each bay supporting 1-lane of network communications, the first receptacle to connect to a multi-lane cable to provide a multi-lane port or connect to a plurality of 1-lane cables to provide a plurality of 1-lane ports, wherein at least two bays of the plurality of bays are to connect to at least one 2-lane joint connector finger cable including a joint finger with differential pair signal pins in a joint area of the joint finger, wherein each bay comprises contacts to detect a type of cable installed based on whether a joint connector finger cable includes a present signal pin, the present signal pin to indicate, based on a connection between the present signal pin and a ground pin, an adjacent lane, and a low signal pin, to indicate, based on a connection between the low signal pin and a ground pin, that a row in the multi-lane cable includes a lane-0;

a second system comprising a second receptacle to connect to a cable; and a cable communicatively coupling the first system to the second system via the first receptacle and the second receptacle.

10. The system of claim 9, wherein the first receptacle comprise four bays, wherein the second receptacle comprises two bays, wherein the cable is a 2-lane cable, and wherein the network chip provides a 2-lane port in response to the 2-lane cable.

11. The system of claim 9, wherein the first receptacle comprise four bays, wherein the second receptacle comprises one bay, wherein the cable is a 1-lane cable, and wherein the network chip provides a 1-lane port in response to the 1-lane cable.

12. The system of claim 9, wherein the cable comprises a split connector finger cable, each finger of the split connector finger cable comprising presence and low signal pins to identify the cable to the first system.

13. The system of claim 9, wherein the first receptacle comprises contacts to detect whether a multi-lane cable or a 1-lane cable is installed in the first receptacle, and wherein the network chip is configured to provide a multi-lane port in response to detecting a multi-lane cable and to provide a 1-lane port in response to detecting a 1-lane cable.

* * * * *